US009161619B1

(12) United States Patent
Somers et al.

(10) Patent No.: US 9,161,619 B1
(45) Date of Patent: Oct. 20, 2015

(54) CONFIGURABLE BOTTLE STORAGE RACK AND KIT

(71) Applicants: Scott R. Somers, Richland, WA (US); Marc Somers, Richland, WA (US)

(72) Inventors: Scott R. Somers, Richland, WA (US); Marc Somers, Richland, WA (US)

( * ) Notice: Subject to any disclaimer, the term of this patent is extended or adjusted under 35 U.S.C. 154(b) by 0 days.

(21) Appl. No.: 14/121,683

(22) Filed: Oct. 7, 2014

(51) Int. Cl.
*A47B 73/00* (2006.01)
*A47B 47/00* (2006.01)
*A47F 5/00* (2006.01)

(52) U.S. Cl.
CPC ..... *A47B 73/006* (2013.01); *A47B 47/0091* (2013.01); *A47B 73/00* (2013.01); *A47F 5/0037* (2013.01); *Y10T 16/53613* (2015.01)

(58) Field of Classification Search
CPC .. A47B 73/00; A47B 47/0091; A47B 73/006; A47F 5/0037; Y10T 16/5362; Y10T 16/5474; Y10T 16/5475; Y10T 16/53613
USPC ..... 211/71.01–74, 77, 78, 169.1, 192, 175, 211/34, 36–38, 195, 144, 186, 150; 16/266, 16/268, 225, 368, 369; 220/4.01, 23.2, 220/23.4
See application file for complete search history.

(56) References Cited

U.S. PATENT DOCUMENTS

| | | | | | |
|---|---|---|---|---|---|
| 574,483 | A | * | 1/1897 | Hutchinson | 122/499 |
| RE12,876 | E | * | 11/1908 | Rodman | 16/369 |
| 923,721 | A | * | 6/1909 | Smith | 108/92 |
| 1,104,933 | A | * | 7/1914 | Richardson | 229/120.01 |
| 1,797,802 | A | * | 3/1931 | Soss | 16/369 |
| 1,984,092 | A | * | 12/1934 | Soss | 16/369 |
| 2,021,702 | A | * | 11/1935 | Soss | 16/369 |
| 2,139,999 | A | * | 12/1938 | Cotts | 220/23.2 |
| 2,558,611 | A | * | 6/1951 | Emmart | 211/74 |
| 2,882,564 | A | * | 4/1959 | Couse et al. | 52/465 |
| 3,102,637 | A | * | 9/1963 | Scholl, Sr. | 211/69 |
| 3,160,278 | A | * | 12/1964 | Varkala | 211/74 |
| 3,210,808 | A | * | 10/1965 | Creager | 52/204.705 |
| 3,245,716 | A | * | 4/1966 | Danner | 297/163 |
| 3,326,268 | A | * | 6/1967 | Dixon | 160/231.2 |
| 3,513,594 | A | * | 5/1970 | Hasselbach | 47/73 |
| 3,523,667 | A | | 8/1970 | Guerrero | |
| 3,606,023 | A | | 9/1971 | Edmunds | |
| D233,878 | S | * | 12/1974 | Berger | D7/600.4 |
| 3,870,155 | A | | 3/1975 | Galloway | |
| 3,978,634 | A | * | 9/1976 | Mack et al. | 52/646 |
| 4,093,076 | A | | 6/1978 | Newton | |
| 4,161,279 | A | * | 7/1979 | Halford | 238/10 F |
| 4,369,000 | A | * | 1/1983 | Egnew | 403/13 |
| 4,516,619 | A | * | 5/1985 | Hasbrouck | 160/135 |

(Continued)

FOREIGN PATENT DOCUMENTS

| | | |
|---|---|---|
| EP | 0 258 155 A2 | 3/1988 |
| GB | 1 202 519 | 8/1970 |

(Continued)

*Primary Examiner* — Joshua J Michener
*Assistant Examiner* — Devin Barnett

(57) ABSTRACT

A configurable bottle storage rack includes front panels, rear panels, panel connecting members, leg members and spacer members. Panel connecting members connect adjacent front panels as well as adjacent rear panels. The panel connecting members can also be attached to the leg members to allow the leg members to support the front and rear panels. The spacer members are disposed between respective front and rear leg members to place the front and rear panels in spaced-apart relationship to one another. The panel connecting members allow adjacent panels to be angled inward towards one another in a concave shape.

11 Claims, 15 Drawing Sheets

(56) References Cited

U.S. PATENT DOCUMENTS

| | | | | | |
|---|---|---|---|---|---|
| 4,550,539 | A | * | 11/1985 | Foster | 52/236.1 |
| D288,156 | S | * | 2/1987 | Nuncio | D7/701 |
| 4,998,631 | A | * | 3/1991 | Fridjhon | 211/74 |
| 5,070,577 | A | * | 12/1991 | Bonneville et al. | 16/260 |
| 5,181,297 | A | * | 1/1993 | Andrews et al. | 24/336 |
| 5,183,278 | A | * | 2/1993 | Wade, Jr. | 280/47.35 |
| 5,370,245 | A | * | 12/1994 | Tersch et al. | 211/74 |
| 5,413,236 | A | * | 5/1995 | Kenevan | 220/4.28 |
| 5,447,249 | A | * | 9/1995 | Vickers | 220/23.83 |
| 5,458,255 | A | | 10/1995 | Addeo et al. | |
| 5,560,500 | A | * | 10/1996 | Wilcox | 211/87.01 |
| 5,782,282 | A | * | 7/1998 | Chen | 160/206 |
| 5,819,959 | A | * | 10/1998 | Martin | 211/118 |
| 5,947,305 | A | | 9/1999 | Lin | |
| 6,015,050 | A | | 1/2000 | Gilbertson | |
| 6,132,158 | A | * | 10/2000 | Pfeiffer et al. | 414/276 |
| 6,443,319 | B1 | * | 9/2002 | Sander | 211/187 |
| 6,467,632 | B1 | * | 10/2002 | Guillot | 211/13.1 |
| 6,499,188 | B1 | * | 12/2002 | Cheng | 16/269 |
| 7,131,544 | B1 | | 11/2006 | Cunningham | |
| 7,398,889 | B1 | * | 7/2008 | McNulty | 211/77 |
| 7,878,340 | B1 | | 2/2011 | Olsen | |
| 8,087,527 | B2 | * | 1/2012 | Johnson | 220/23.4 |
| 8,579,008 | B2 | * | 11/2013 | Svenson | 160/235 |
| 8,985,366 | B2 | * | 3/2015 | Barth | 220/23.4 |
| 2003/0150830 | A1 | * | 8/2003 | Crown et al. | 211/175 |
| 2004/0262308 | A1 | * | 12/2004 | Hase | 220/23.4 |
| 2008/0237159 | A1 | * | 10/2008 | Bray et al. | 211/59.2 |
| 2008/0251478 | A1 | * | 10/2008 | Jaskowski | 211/74 |
| 2009/0120886 | A1 | * | 5/2009 | Weiss et al. | 211/74 |
| 2011/0036791 | A1 | * | 2/2011 | Huang | 211/74 |
| 2011/0132853 | A1 | * | 6/2011 | Drobot et al. | 211/42 |
| 2012/0120618 | A1 | * | 5/2012 | Bohn | 361/749 |
| 2012/0224311 | A1 | * | 9/2012 | Sutherland et al. | 361/679.01 |
| 2012/0285952 | A1 | * | 11/2012 | James et al. | 220/23.4 |
| 2013/0119004 | A1 | * | 5/2013 | Lange | 211/74 |
| 2013/0162133 | A1 | * | 6/2013 | Arslankiray et al. | 312/405 |
| 2014/0231425 | A1 | * | 8/2014 | Jian et al. | 220/7 |
| 2014/0339182 | A1 | * | 11/2014 | Koder et al. | 211/75 |

FOREIGN PATENT DOCUMENTS

| | | | |
|---|---|---|---|
| GB | 1 330 786 | | 9/1973 |
| GB | 2 158 899 | A | 10/1985 |
| WO | WO 98/03098 | | 1/1998 |

* cited by examiner

CONFIGURABLE BOTTLE STORAGE RACK AND KIT

BACKGROUND

Modular bottle storage racks (e.g., for storing bottles of wine in an essentially horizontal position) are well known. (See for example U.S. Pat. Nos. 3,606,023 and 4,093,076.) These racks can be assembled by a user from component parts in order to allow to the user to assemble a rack of desired dimensions (typically height and width). However, these racks cannot be assembled in a continuous manner to accommodate a wall (or a display) having an inside corner, or an outside corner. However, one bottle rack system that can be assembled in order to accommodate inside corners is described in U.S. Pat. No. 7,131,544. The bottle rack of U.S. Pat. No. 7,131,544 (i.e., "U.S. '544") includes a plurality of octagonal tubes that can be connected to one another in a side-by-side arrangement at adjacent ends of the tubes. The tubes (which are used to hold bottles) can then be splayed apart away from the connected ends in order to achieve a curved bank of bottle holding tubes. The bank of tubes is then supported in a preformed frame. As can be appreciated, the modularity of the bottle rack of U.S. '544 is limited by the preformed frame which supports the tubes. Further, as depicted in U.S. '544, 24 bottles are needed to complete a 90 degree inside corner, which results in an inefficient use of space in the corner. In U.S. '544, the ability to navigate an inside corner is based on the width of a tube configured to support a bottle, and does not allow for incremental spacing between the tubes. That is, in U.S. '544 the outer ends of the tubes which support the bottles are necessarily adjacent to one another, and thus increasing the angle between the tubes (in order to reduce the number of tubes required to negotiate an inside corner) will result in the necks of bottles stored in the tubes colliding with one another.

DETAILED DESCRIPTION

I have developed a configurable bottle storage rack (for storing bottles of wine or the like in an essentially horizontal position) which can be configured by an assembly of component parts in order to achieve one or more desired vertical spans, one or more desired horizontal spans, and also to negotiate inside and outside corners, all as desired by an end user. The component parts allow for subsequent expansion of the bottle storage rack. Further, the configurable bottle storage rack can provide for efficient use of space when negotiating an inside corner since the portion of the rack which is configured to negotiate an inside corner can be configured to hold four bottles.

The configurable bottle storage rack includes five primary components, as follows: front bottle support panels; rear bottle support panels; panel connecting members (also described herein as panel hinge members); leg members; spacing members; and securing members. As will be described in detail herein below, the front panels, as well as the rear panels, can be connected to one another in a side-by-side arrangement using the panel connecting members. The panel connecting members can be attached to the leg members using the securing members in order to allow the front and rear panels to be arranged vertically. The spacing members can be attached to the leg members to place the front and rear panels in horizontally spaced-apart configuration. As can be appreciated, the present disclosure also provides for a configurable bottle storage rack kit which includes the primary components recited above.

Figure 1:
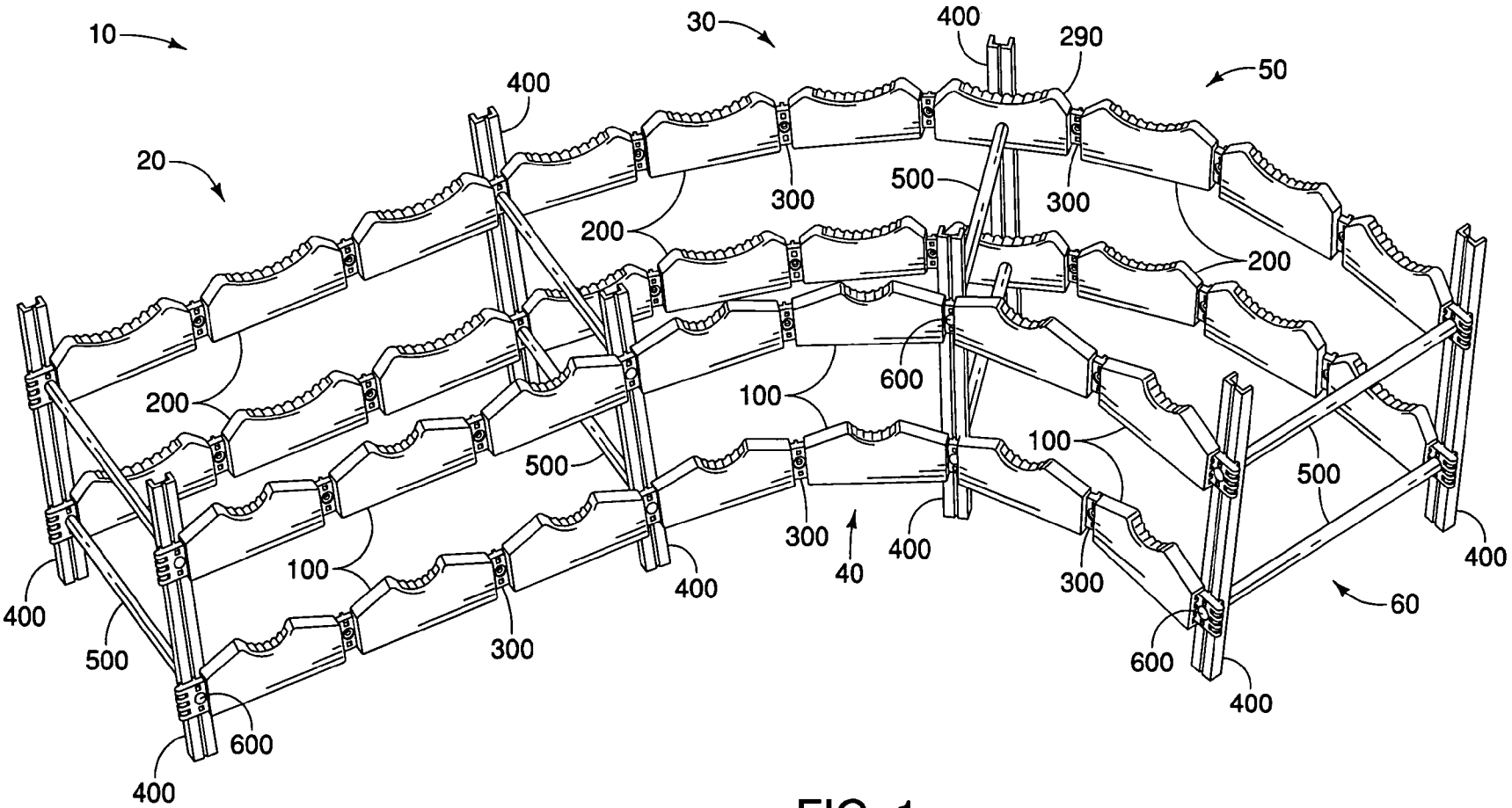
FIG. 1 is a perspective view of a configurable bottle storage rack in accordance with the present disclosure.

With reference to the accompanying drawings, FIG. 1 is a perspective view of one configuration of the configurable bottle storage rack 10 in accordance with the present disclosure. (The configurable bottle storage rack will also be referred to herein as the bottle rack.) The bottle rack 10 depicted in FIG. 1 includes a bottle rack straight section 20 and a bottle rack inside-corner accommodating section 30. The bottle rack 10 includes a bottle rack front assembly 40 and a bottle rack rear assembly 50. The bottle rack front and rear assemblies are spaced apart from one another by a bottle rack spacer assembly 60. The bottle rack front assembly 40 includes a plurality of front bottle support panels 100 that are joined to one another in a side-by-side arrangement by panel connecting members 300. Likewise, the bottle rack rear assembly 50 includes a plurality of rear bottle support panels 200 that are joined to one another in a side-by-side arrangement by panel connecting members 300. The bottle rack front assembly 40 further includes leg members 400 to which are attached the panel connecting members 300. The front panels 100 and rear panels 200 are thus supported indirectly by the leg members 400 by virtue of being connected to the panel connecting members 300. The front panels 100 can thus be arranged in a spaced-apart vertical manner. Likewise, the rear panels 200 can also be arranged in a spaced-apart vertical manner in this way. The bottle rack front assembly 40 and the bottle rack rear assembly 50 are spaced apart from one another by spacing members 500. The positioning of the spacing members 500 in the bottle rack 10 will be described in more detail below, and specifically with respect to FIGS. 22 and 23. While FIG. 1 depicts two rows of front panels 100 and two rows of respective rear panels 200, it will be appreciated that the bottle rack 10 can include only a single row of front panels and rear panels. Moreover, it will be appreciated that the bottle rack 10 can include additional rows (i.e., a total of three of more rows) of front panels 100 and corresponding rear panels by increasing the height of the leg members 400.

Figure 2:
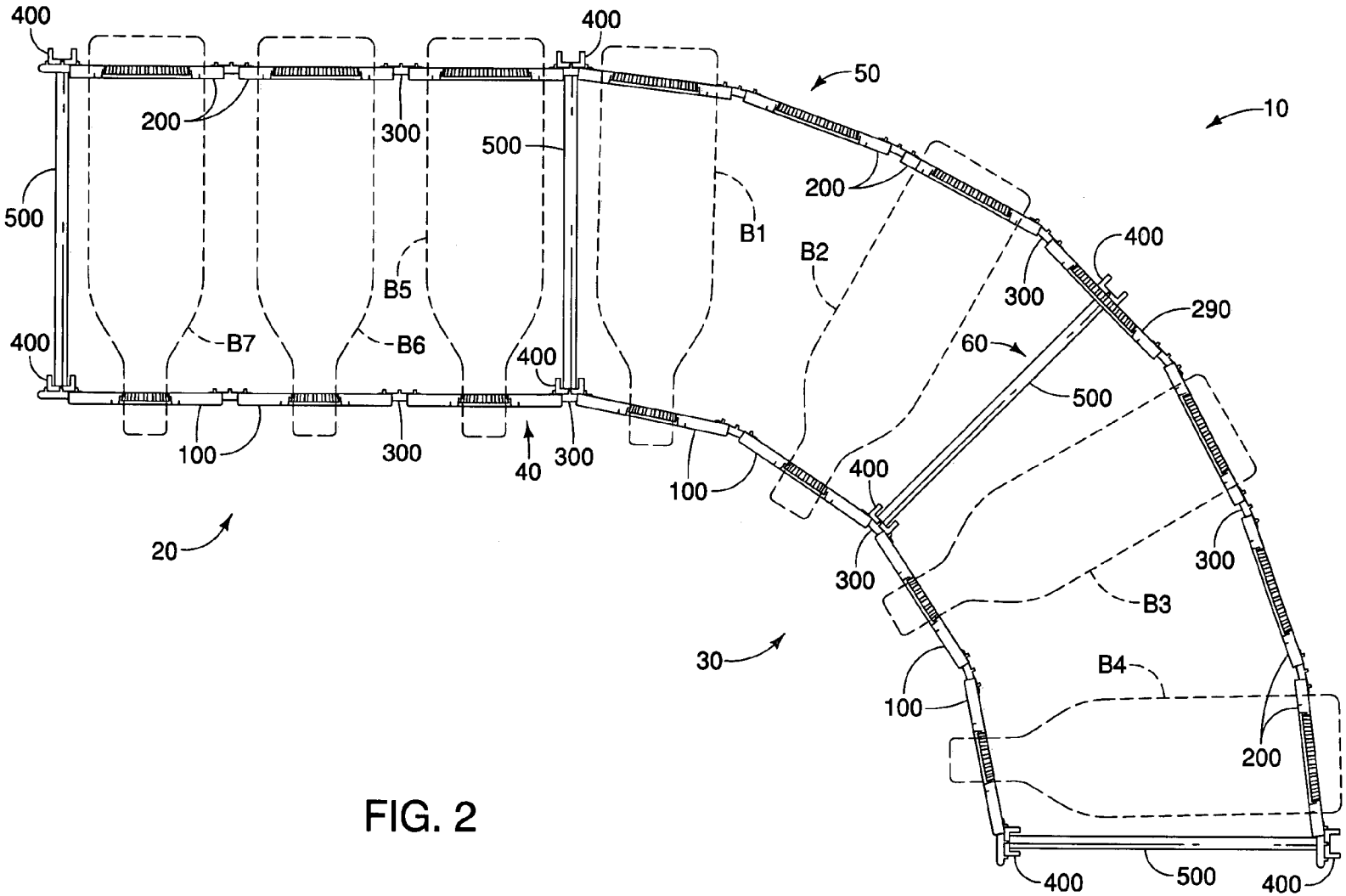
FIG. 2 is a top view of the configurable bottle storage rack depicted in FIG. 1.

FIG. 2 is a plan view of the bottle rack 10 depicted in FIG. 1. FIG. 2 shows the bottle rack straight section 20 and the bottle rack inside-corner accommodating section 30, as well as the bottle rack front assembly 40 and the bottle rack rear assembly 50, along with the bottle rack spacer assembly 60 (described in more detail below). As can be seen in FIG. 2, the bottle rack inside-corner accommodating section 30 circumscribes an arc of 90 degrees, allowing this section of the bottle rack 10 to be placed at an inside corner of a wall. As can also be seen, the inside-corner section 30 of the bottle rack 10 can support four bottles (bottles B1-B4, shown in phantom lines) by virtue of the four front bottle support panels 100 in this section. The bottles B1-B4 are also supported by four of the seven rear bottle support panels 200. That is, the first, second, sixth and seventh rear panels 200 align with the corresponding first, second, third and fourth front panels 100 in order to support four bottles (B1-B4). Thus, the third, fourth and fifth rear panels 200 do not act to support any bottles, but merely act as spacers in order to accommodate the outside corner radius of the rear assembly 50 of the bottle rack corner section 30 about the inside wall corner. The inside-corner section 30 of the bottle rack 10 thus presents a space efficient solution to placing a bottle rack around an inside wall corner. FIG. 2 also shows the bottle rack straight section 20, depicted here as having three front bottle support panels 100 and three parallel rear bottle support panels 200, and supporting bottles B5-B7 (depicted in phantom lines). It will be appreciated that the bottle rack straight section 20 can be further extended to hold more bottles. Likewise, a bottle rack straight section 20 can be attached to the free end of the bottle rack inside-corner section 30.

Figure 3:
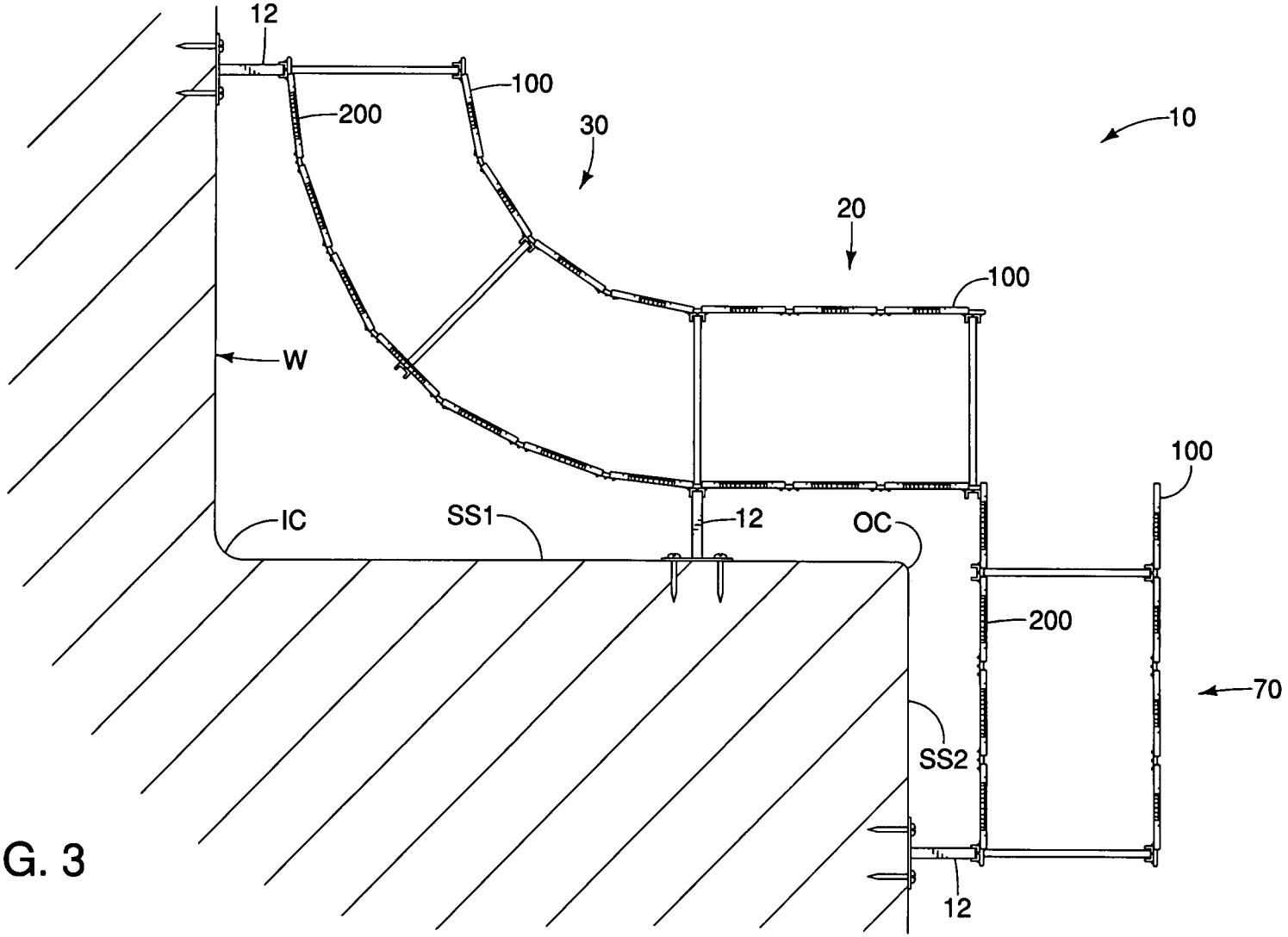
FIG. 3 is a top view diagram depicting how the configurable bottle storage rack can be arranged with respect to wall corners.

FIG. 3 is a plan view diagram depicting how the bottle storage rack 10 can be positioned proximate a wall "W" having an inside corner "IC", an outside corner "OC", and straight sections "SS1" and "SS2". The bottle rack corner section 30 can be placed proximate the inside wall corner IC, and the bottle rack straight section 20 can extend therefrom along the first straight wall section SS1. A second bottle rack straight section 70 can be placed proximate the second straight wall section SS2, at ninety degrees to the first bottle rack straight section 20. The first and second bottle rack straight sections 20 and 70 can be connected to one another, or can be independent of one another. Outside corners having angles other than 90 degrees can also be accommodated in this way. The bottle rack 10 can be secured to the wall W using wall anchors 12, as described more fully below.

Figure 4:
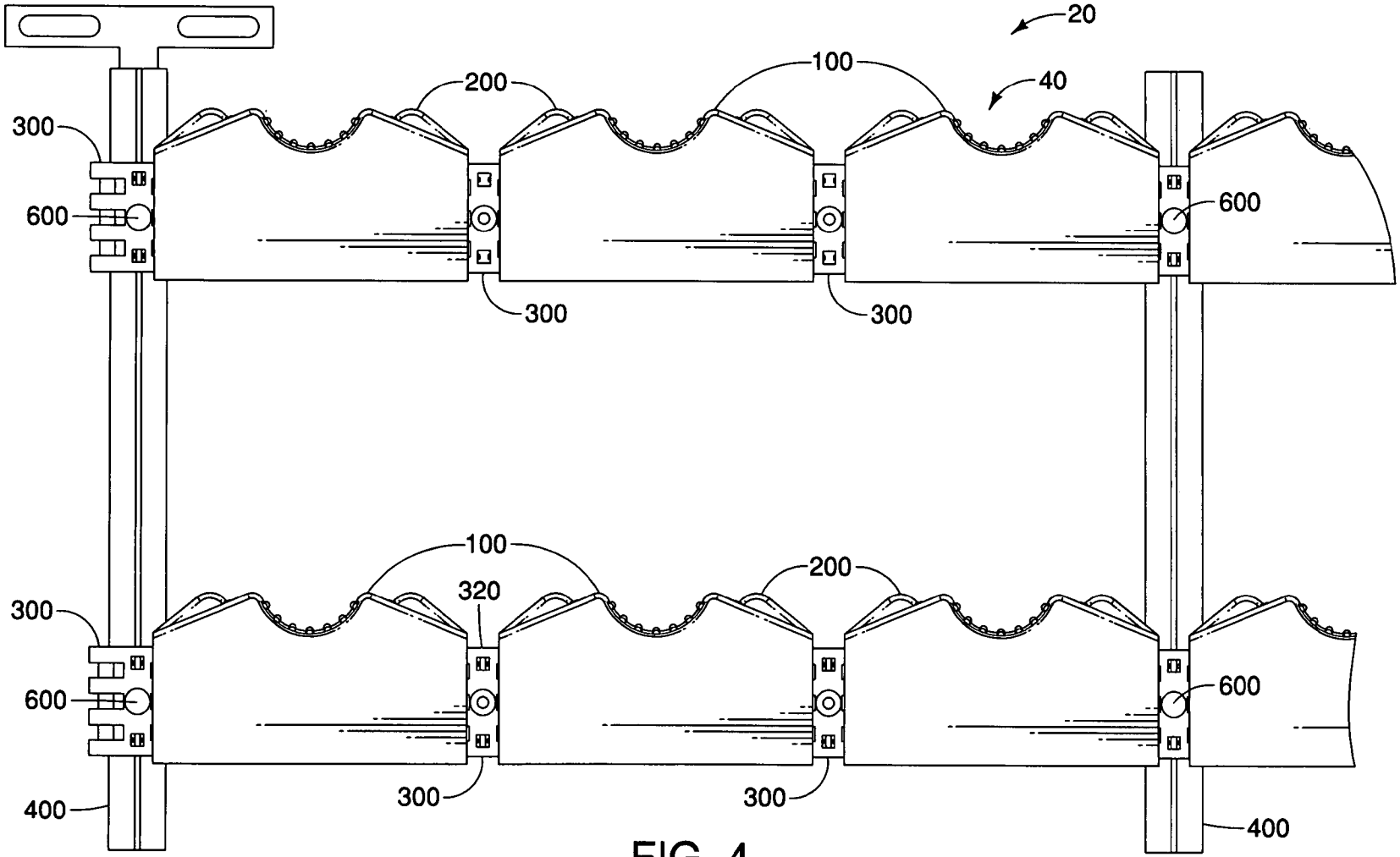
FIG. 4 is a front view of a straight-run portion of the configurable bottle storage rack depicted in FIG. 1.

FIG. 4 is a front view of the bottle rack straight section 20. The bottle rack front assembly 40 is in the foreground of this image. The bottle rack straight section 20 depicted in FIG. 4 includes front bottle support panels 100 which are joined together in horizontal adjacent side-by-side arrangement by panel connecting members 300. A partial upper edge of the rear bottle support panels 200 can be seen above the top edge of the front bottle support panels 100. This reflects the difference in shape between the front and rear panels 100, 200. (As described more fully below, there is a storage reason to the differences the shapes of panels in 100 and 200—specifically, the difference in shape allows for a bottle to be resting downward at slope about 5 degrees, which is desirable for a Bordeaux bottle to allow the leas to settle at the bottle rim and reducing surface area of the inherent bubble at a top butt of a bottle.) At each end of the exemplary bottle rack straight section 20 legs 400 support the bottle rack section. The panel connecting members 300 located at the legs 400 are attached to the legs by securing members 600. Securing members 600 will be described more fully below. As depicted in FIG. 4, two or more horizontal spans of front panels 100 can be arranged vertically with respect to one another. While legs 400 are depicted as being placed at the ends of three horizontally adjacent front panels 100, the leg spacing can be increased or decreased as desired to accommodate wall lengths, to provide additional rigidity to the bottle rack, or to place one or more legs 400 adjacent to a wall joist for securing the bottle rack to the wall. Not shown in FIG. 4, but visible in the plan view of FIG. 2, are additional leg members 400 (rear leg members) which are parallel to the front leg members 400. The front and rear leg members 400 are preferably identical in all relevant aspects, and only differ by their relative position within the overall bottle storage rack 10 (FIG. 2).

Figure 26:
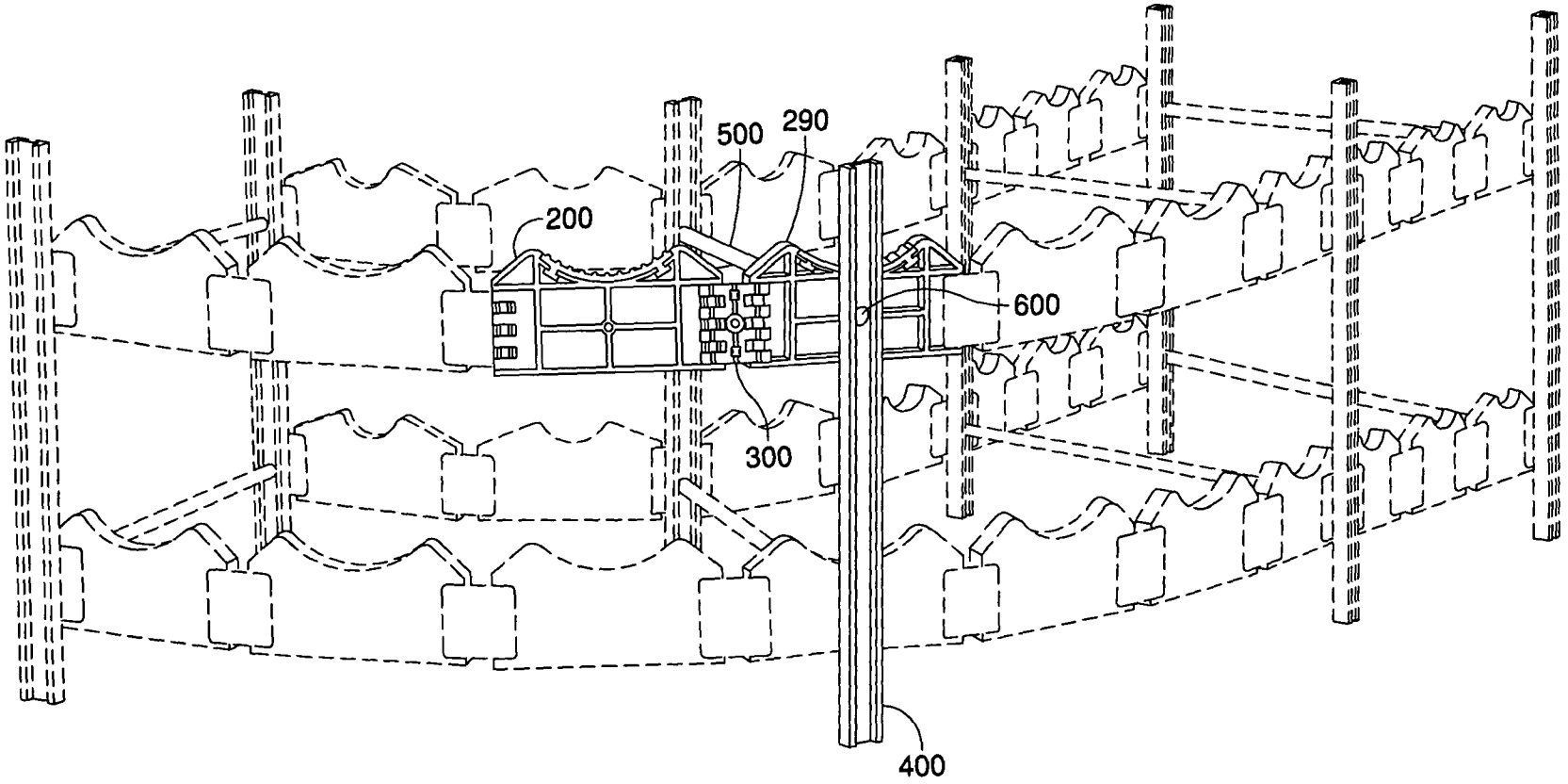
FIG. 26 is a rear perspective view of a curved portion of the configurable bottle storage rack depicted in FIG. 1.

FIG. 26 is a rear perspective view of the bottle rack inside corner accommodating section 30 of the bottle rack 10 depicted in FIGS. 1 and 2. FIG. 26 is provided only to provide further illumination of the bottle rack inside corner accommodating section 30. Reference numbers shown in FIG. 26 are as described above with respect to FIG. 1, or as will be describe below.

Figure 5:
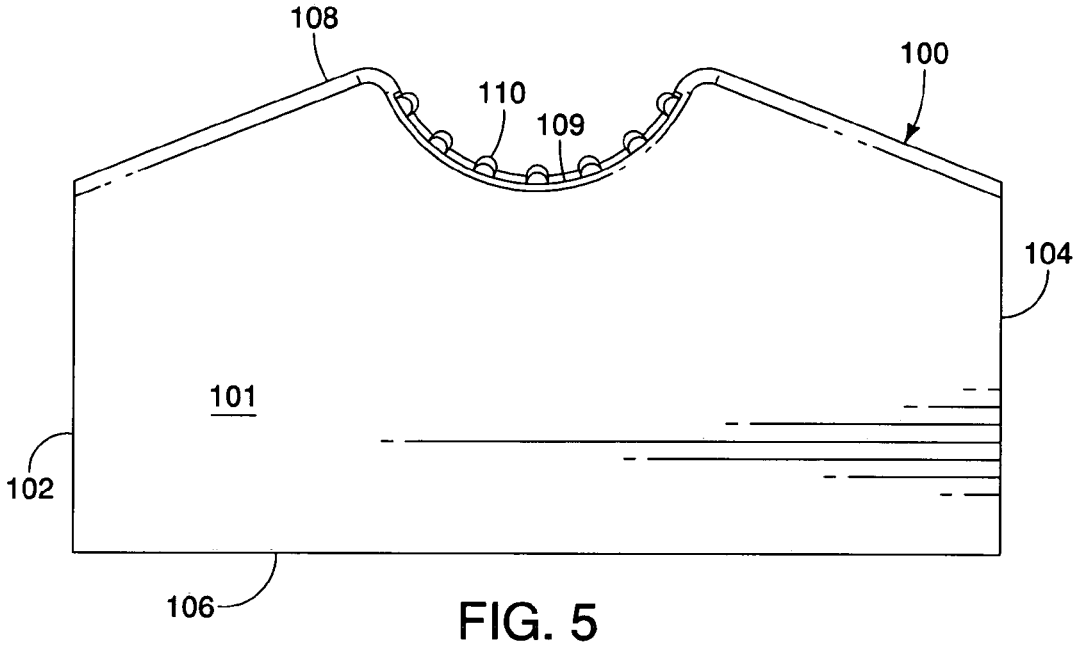
FIG. 5 is a front view of a front bottle support panel used in the configurable bottle storage rack depicted in FIG. 1.

FIG. 5 is a front view of an exemplary front bottle support panel 100, as shown in FIG. 4. The front bottle support panel 100, or front panel, is defined by a front panel outside surface 101, a front panel first side 102, an opposite front panel second side 104, a front panel bottom side 106, and an opposite front panel top side 108. The front panel top side 108 includes a concave surface 109, or front panel bottle neck support surface 109, into which can be placed a bottle neck support non-slip insert 110. In this instance it is assumed that the user wishes to use the bottle storage rack (e.g., 10, FIG. 2) to store bottles having a neck portion which is narrower than an opposite bottom portion, such as is typically the case with bottles of wine and spirits. Further, when storing wine bottles and the like, users typically prefer to have the neck of the bottle facing outward so that identifying information on the top of the bottle (such as a winery logo) can be more easily seen. However, it will be appreciated that the term "front panel" is relative, and the user can use the panels 100 in front or rear positions within the bottle rack. The non-slip insert 110 can be fabricated from rubber or the like to provide a high friction surface to resist movement of a bottle supported by the insert, and can also act as a vibration dampener to assist in isolating a bottle neck from small vibrations. Alternately the non-slip insert 110 can be formed as an integral part of the front panel top side 108, in which case it is not an insert, but merely a non-slip section of the top side 108. In one example the front panel 100 is fabricated from acrylonitrile butadiene styrene (or ABS) plastic by injection molding.

Figure 6:
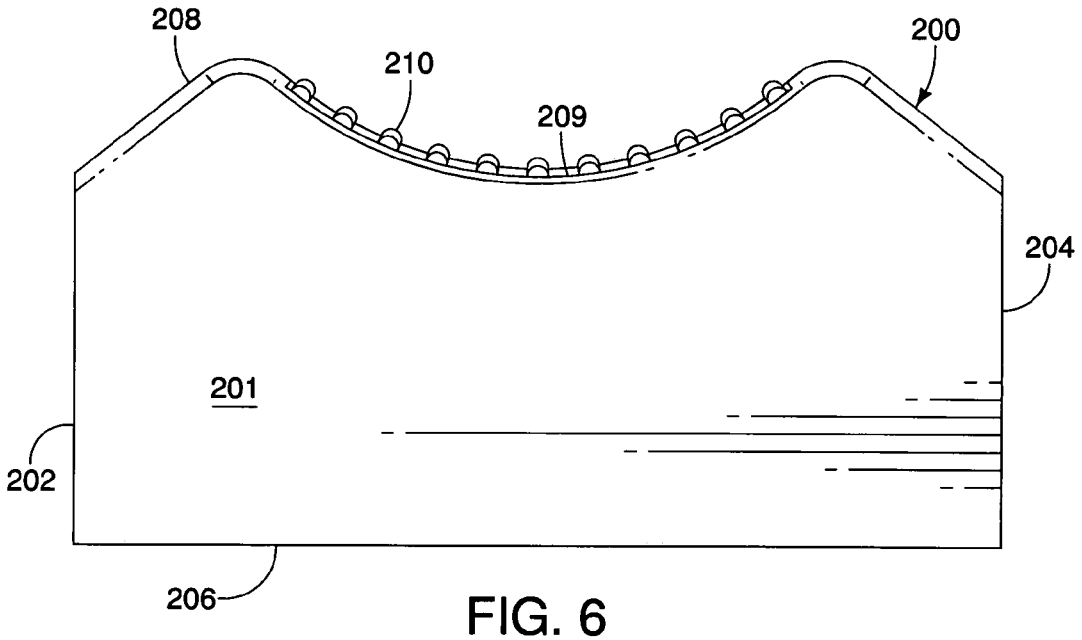
FIG. 6 is a front view of a rear bottle support panel used in the configurable bottle storage rack depicted in FIG. 1.

FIG. 6 is a front view of an exemplary rear bottle support panel 200, as shown in FIG. 4. The rear bottle support panel 200, or rear panel, is defined by a rear panel outside surface 201, a rear panel first side 202, an opposite rear panel second side 204, a rear panel bottom side 206, and an opposite rear panel top side 208. The rear panel top side 208 includes a concave surface 209, or rear panel bottle bottom support surface 209, into which can be placed the bottom of a bottle, supported by the non-slip insert 210. In this instance it is assumed that the user wishes to use the bottle storage rack (e.g., 10, FIG. 2) to store bottles having a neck portion which is narrower than an opposite bottom portion, and to have the bottle bottom positioned proximate the rear portion of the bottle rack. However, it will be appreciated that the term "rear panel" is relative, and the user can use the panels 200 in front or rear positions within the bottle rack. The non-slip insert 210 can be fabricated from rubber or the like to provide a high friction surface to resist movement of a bottle supported by the insert, and can also act as a vibration dampener to assist in isolating a bottle bottom from small vibrations. Alternately the non-slip insert 210 can be formed as an integral part of the rear panel top side 208, in which case it is not an insert, but merely a non-slip section of the top side 208. In one example the rear panel 200 is fabricated from ABS plastic by injection molding.

Figure 6A:
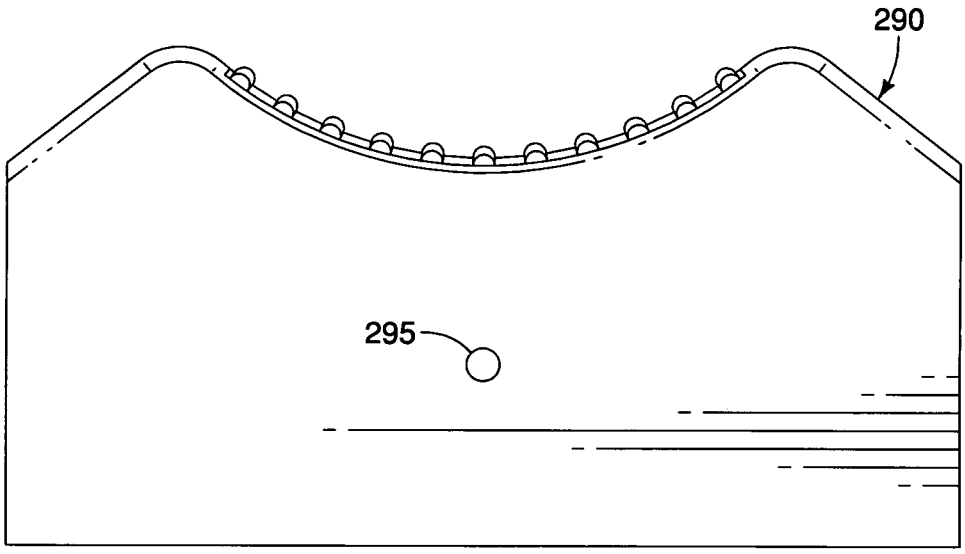
FIG. 6A is a front view of a special rear bottle support panel used in the configurable bottle storage rack depicted in FIG. 1.

FIG. 6A is a front view of a special rear bottle support panel 290, as shown in FIGS. 1 and 2. The special rear bottle support panel 290 can be essentially identical to the rear panel 200 of FIG. 6, with the difference being the inclusion of a generally centrally positioned special rear panel leg mounting hole 295. The special rear panel mounting hole 295 is configured to receive the securing member 600 (described more fully below). The special rear panel 290 can be used as part of an inside corner section 30 of the bottle rack in order to allow a leg member 400 and a spacing member 500 to be positioned at the center of the special panel 290, rather than positioning the leg 400 and spacing member 500 adjacent a side of the panel. (As can be seen in FIG. 2, leg members 400 and spacing members 500 are typically located at the junction between panels (100, 200) by virtue of the panel connecting members 300.) The use of the special rear panel 290 allows the number of front and rear panels (100, 200) within an inside-corner section 30 to differ by an odd number. For example, in FIG. 2 the number of front panels 100 in the inside corner section 30 is four, and the number of rear panels 200 in this section is seven, so a difference of three panels. This odd-number difference in the number of panels necessitates that the central rear panel 290 will align with the central joint (central panel connecting member 300) in the front portion of the bottle rack corner section 30, and thus prevents a leg member 400 and spacing member 500 from being positioned at a corresponding rear panel connecting member located proximate the apex of the inside corner. The use of the special rear panel 290 allows a leg member 400 and a spacing member 500 to be placed at this position by allowing them to be connected centrally to the special rear panel by use of the special rear panel leg mounting hole 295. It will be appreciated that the special rear panel 290 does not need to be provided with the non-slip surface 210 of the general rear panel 200 of FIG. 6.

Figure 7:
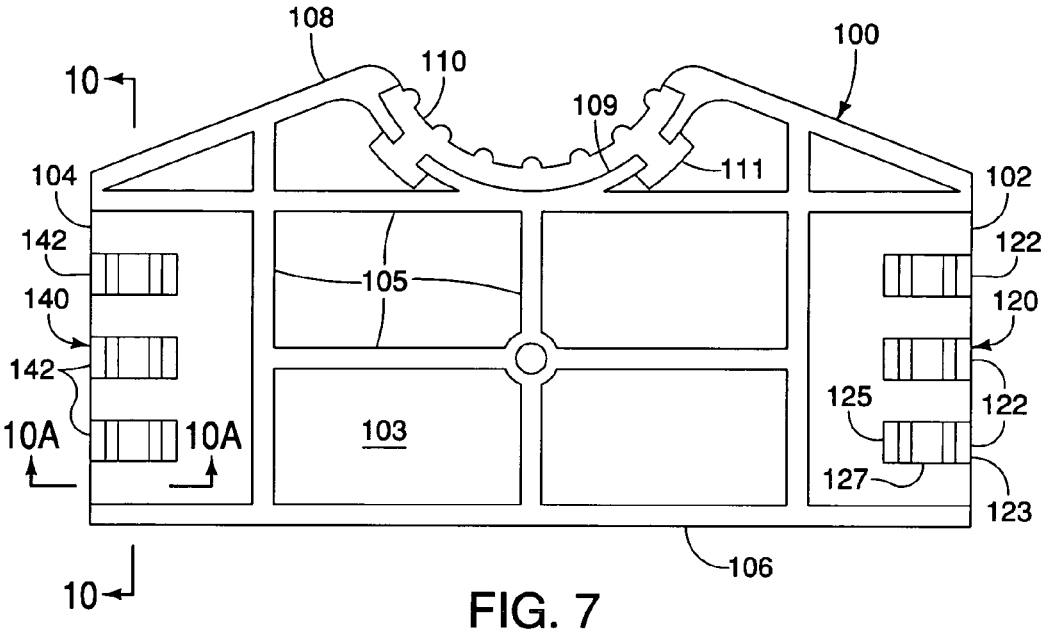
FIG. 7 is a rear view of the front bottle support panel depicted in FIG. 5.

FIG. 7 is a rear view of the front bottle support panel 100 depicted in FIG. 5. The first and second sides 102, 104 of the front panel 100 are shown, as well as the front panel bottom side 106 and front panel top side 108. The non-slip insert 110 is depicted as being held in placed by tabs 111 which fit into the bottle neck support surface 109. The front panel 100 is further defined by a front panel inside surface 103. The front panel 100 can include structural features 105 formed on the inside surface 103 in order to provide strength and rigidity to the front panel 100. The front panel 100 further includes a first hinge section 120 located at the first side 102 of the front panel, and a second hinge section 140 located at the second side 104 of the front panel. The front panel hinge sections 120, 140 enable the front panel 100 to be connected to panel connecting members 300 (see FIG. 4, and as described more fully below). The front panel hinge sections 120, 140 each include one or more respective hinge clips 122, 142. In the example depicted in FIG. 7, each hinge clip (122, 142) includes a pair of outward-extending clips arms (e.g., clip arms 123, 125 for lowermost hinge clip 122). The outward-extending clip arms 123, 125 bracket a hinge receiver 127. The clip arms 123, 125 can be fabricated from a material (such as ABS plastic) that has a degree of flexibility and resilience to allow the clip arms to move outward slightly in order to allow a hinge of the connecting member 300 (described below) to be received within the hinge receiver 127, and to then return to their original (or near-original) position in order to capture the hinge within the hinge receiver 127. In the example depicted in FIG. 7 each hinge section 120, 140 is provided with three hinge clips (122, 142 respectively). This configuration lessens the resistance of the hinge clip arms (e.g., 123, 125) to expansion (in order to receive the hinge) versus using a single elongated hinge clip for each hinge section. The front panel hinge sections 120, 140 will be described in more detail below.

Figure 8:
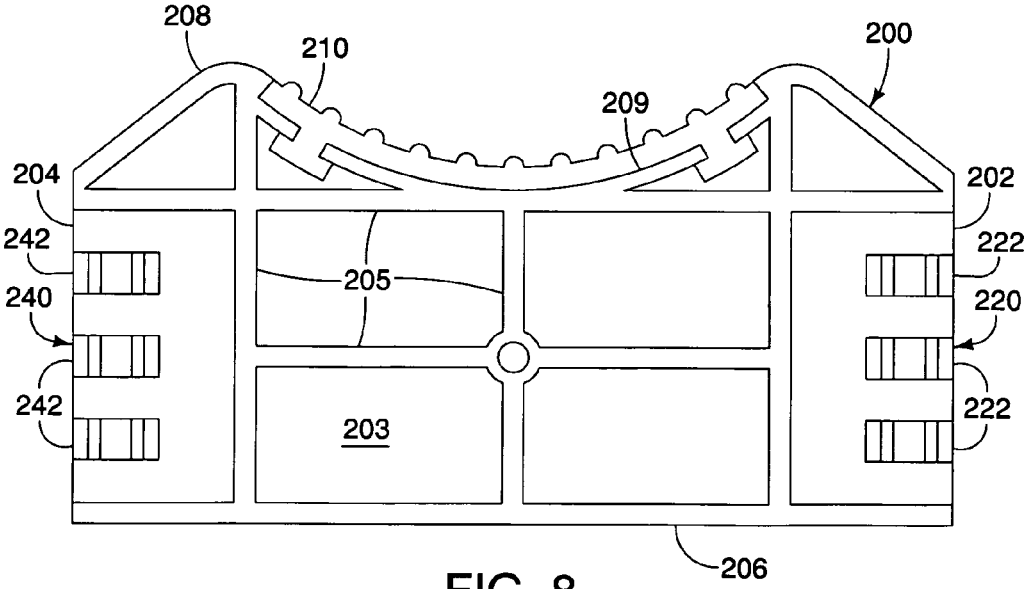
FIG. 8 is a rear view of the rear bottle support panel depicted in FIG. 6.

FIG. 8 is a rear view of the rear bottle support panel 200 depicted in FIG. 6. The first and second sides 202, 204 of the rear panel 200 are shown, as well as the rear panel bottom side 206 and rear panel top side 208. The rear panel non-slip insert 210 is depicted as being held in placed by tabs 211 which fit into the bottle bottom support surface 209. The rear panel 200 is further defined by a rear panel inside surface 203. The rear panel 200 can include structural features 205 formed on the inside surface 203 in order to provide strength and rigidity to the rear panel 200. The rear panel 200 further includes a first hinge section 220 located at the first side 202 of the rear panel, and a second hinge section 240 located at the second side 204 of the front panel. The rear panel hinge sections 220, 240 enable the rear panel 200 to be connected to panel connecting members 300 (see FIG. 4, and as described more fully below). The rear panel hinge sections 220, 240 each include one or more respective hinge clips 222, 242. The rear panel hinge sections 220, 240 are generally the same as the front panel hinge sections 120, 140 in all relevant details.

Figure 9:
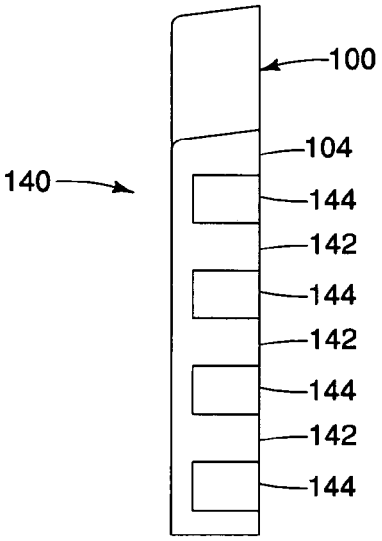
FIG. 9 is a side view of the front bottle support panel depicted in FIG. 5.

FIG. 9 is a side view of the second side 104 of the front panel 100 depicted in FIGS. 5 and 7. A portion of the hinge clips 142 (three each) can be seen from the side. Between, and at each end, of the hinge clips 142 are hinge openings 144. The hinge openings 144 allow the panel connecting member 300 to be received within the hinge clips 142, and also allow the connecting member to rotate slightly forward in the hinge section 140 of the front panel 100. The side view of the first side 102 of the front panel 100 is similar in all material aspects to the side view of the second side 104 of the front panel. Likewise, the first side 202 and the second side 204 of the rear panel 200 depicted in FIGS. 6 and 8 are similar in all material aspects to the side view of the front panel second side 104 depicted in FIG. 9. That is, each side of the front and rear panel 100, 200 includes a portion of the hinge clips (122, 124, 222, 224), and hinge openings (144, FIG. 9) defined between and at each end (i.e., top and bottom) of the hinge clips.

Figure 10:
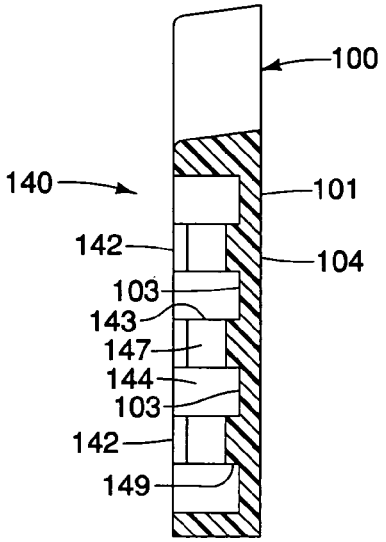
FIG. 10 is a side sectional view of the hinge section of the front bottle support panel depicted in FIG. 7.

FIG. 10 is a side sectional view of the front panel 100 depicted in rear view in FIG. 7. The sectional view depicted in FIG. 10 is taken through the second hinge section 140 proximate the second side 104 of the front panel 100. For ease of understanding, only one of each component of the hinge section 140 has been numbered in FIG. 10 in order to reduce clutter on the drawing figure. The hinge section includes three hinge clips 142. The outer clip arms 143 of the hinge clips 142 can be seen in this sectional view. The clip arms (143) define the hinge receiver 147. The hinge openings 144 (see also FIG. 9) are defined between the hinge clips 142. The hinge clips 142 are extended away from the inside surface 103 of the front panel 100 by the hinge clip posts 149. In this way, when the hinge of a panel connecting member 300 is received within the hinge receivers 147, the hinge will stand off from the inside surface 103 of the front panel.

Figure 10A:
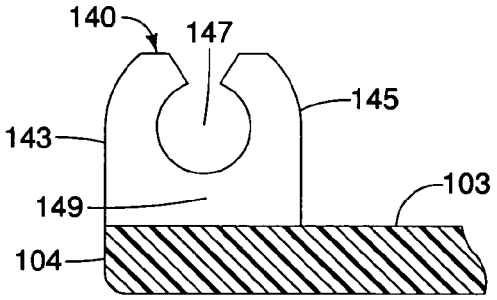
FIG. 10A is a partial bottom sectional view of the hinge section of the front bottle support panel depicted in FIG. 7.

FIG. 10A is a partial bottom sectional view of the second hinge section 140 of the front bottle support panel 100 depicted in FIG. 7, taken at the second side 104 of the front panel. In FIG. 10A one of the hinge clips 142 can be seen in bottom view. The hinge clip 142 includes first and second clip arms 143, 145, which together define the hinge receiver 147. As depicted in this example, the hinge receiver 147 is spaced away from the inside surface 103 of the front panel 100 by the hinge clip post 149.

Figure 11:
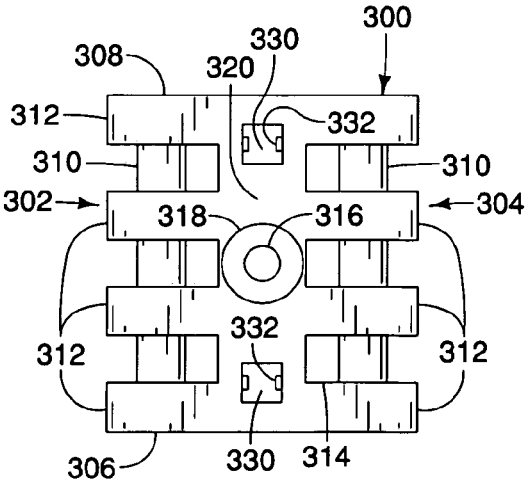
FIG. 11 is a front view of a panel connecting member used in the configurable bottle storage rack depicted in FIG. 1.

Turning now to FIG. 11, an exemplary panel connecting member (also described herein as a connecting member, or panel connector) 300 is shown in a front view. The panel connector 300 is defined by a panel connector first side 302, a panel connector second side 304, a panel connector bottom 306 (panel connector bottom member 306) and a panel connector top 308 (panel connector top member 308). The panel connector 300 includes panel connector hinges (or hinges) 310. In cross section, the hinges 310 are generally circular in shape, and thus form hinge barrels to be received by the clip arms (e.g., 123, 125, FIG. 7) of the front and rear panels (100, 200), as described above. The panel connector 300 can further include hinge tabs 312 which extend outward from the hinges 310. The hinge tabs 312 are configured to be received in the hinge openings (e.g., 144, FIG. 10) between the hinge clips (e.g., 142, FIG. 10) proximate the inner clip arms (e.g., clip arms 145, FIG. 10A) of the front and rear panels (100, 200). The hinge tabs 312 assist in restraining vertical movement of the hinges 310 within the hinge clips (e.g., hinge clips 122 and 144, FIG. 7). The panel connector 300 can be further defined by clip arm receivers 314, which are formed as openings in the connecting member. The clip arm receivers 314 are configured to receive the outer clip arms (e.g., clip arm 143, FIG. 10A) when the connecting member 300 is attached to a front or rear panel (100, 200). The panel connector 300 further includes a central element 320 which is centrally located between the two hinges (310) and the clip arm receivers 314. A securing member opening 316 (connecting member securing pin opening 316) is formed in the central element 320 to receive the securing member 600 (FIG. 4, for example), and a securing member head recess 318 can be provided around the securing member opening 316 to allow a head of the securing member (600) to be flush with the central element 320. As can be seen from FIG. 11, the connecting member 300 is essentially symmetrical about a horizontal line which passes through the securing member opening 316. This feature of symmetry allows a user who is assembling a bottle rack using the component parts (and especially the connecting member 300) to not be concerned with up-down orientation of the connecting member. The panel connecting member 300 thus includes parallel hinges 310 located at opposite sides (302, 304) of the connecting member, and a central element 320 which is parallel to the hinges. The hinges 310 and the central element 320 of the connector member 300 are held in spaced-apart orientation by the panel connector bottom member 306 and the panel connector top member 308. The central element 320 is configured to be placed over a leg member (400) and attached to the leg member using a securing member (600), and front panels 100 (or rear panels 200) can then be attached to the connector element 300 to thus secure the panels to the leg member (as will be described in more detail below).

Figure 12:
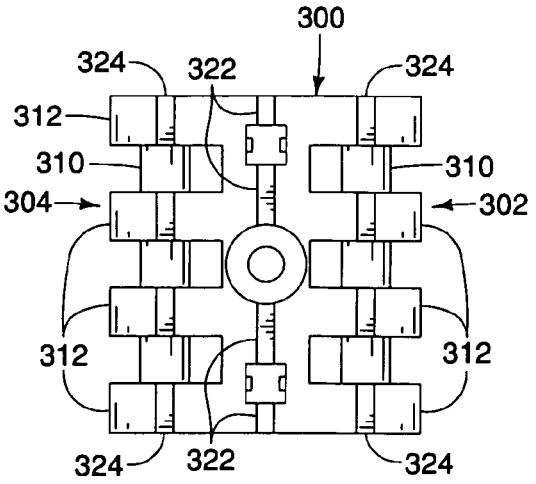
FIG. 12 is a rear view of the panel connecting member depicted in FIG. 11.

FIG. 12 is a rear view of the panel connecting member 300 depicted in FIG. 11. In addition to the already-described elements and features of the connecting member that are depicted in both FIGS. 11 and 12, the rear view of FIG. 12 shows that the connecting member 300 can include leg alignment tabs 322 and leg bracketing tabs 324. The leg alignment tabs 322 are configured to be received within a connecting member alignment feature (described further below) in the leg member 400, while the leg bracketing tabs 324 are configured to receive the side edges of the leg member 400 and thus facilitate orienting the connecting element 300 with the leg member 400 when assembling a bottle rack using the panel connector and leg components.

Figure 13:
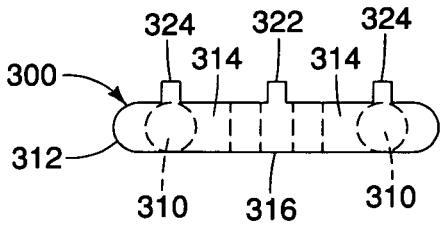
FIG. 13 is a top view of the panel connecting member depicted in FIG. 11.
Figure 14:
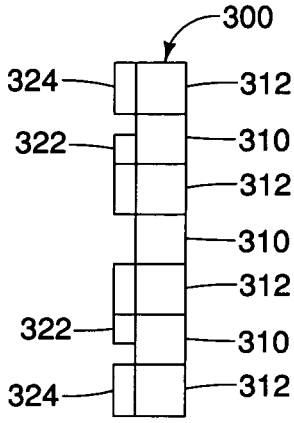
FIG. 14 is a side view of the panel connecting member depicted in FIG. 11.
Figure 15:
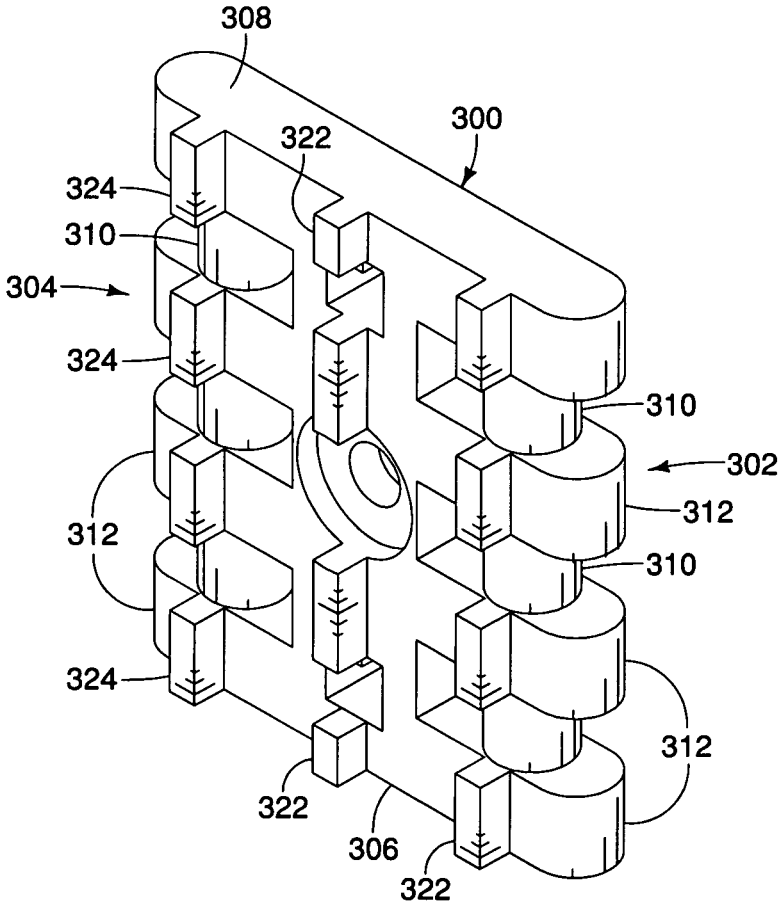
FIG. 15 is an isometric view of the panel connecting member depicted in FIG. 11.

FIG. 13 is a plan (top or bottom) view of the panel connecting member 300 of FIGS. 11 and 12. The leg alignment tabs 322 and leg bracketing tabs 324 are visible as projecting from the back of the connecting element 300. The clip arm receivers 314 and the securing member opening 316 are shown by hidden lines indicating that the openings 314 and 316 pass entirely through the connecting member 300. FIG. 14 is a side view of the panel connecting member 300 of FIGS. 11-13. In FIG. 14 the three hinges 310 are seen, each hinge being bracketed by two hinge tabs 312. FIG. 15 is a isometric rear view of the panel connecting member 300 of FIG. 12, and facilitates visualization of the component elements and features thereof (and described herein above).

Figure 16:
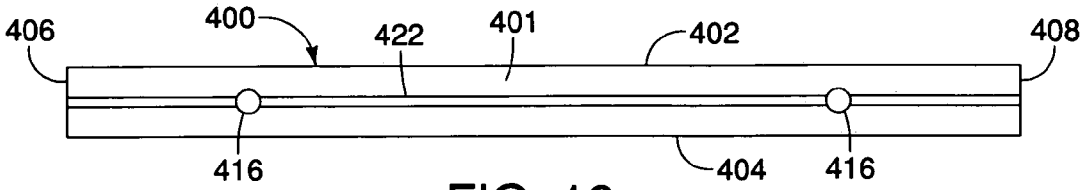
FIG. 16 is a front view of a leg member used in the configurable bottle storage rack depicted in FIG. 1.
Figure 17:
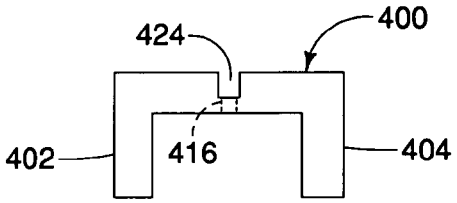
FIG. 17 is a top view of the leg member depicted in FIG. 16.

FIG. 16 is a front view of a leg member 400 that can be used for the bottle storage rack 10 of FIGS. 1, 2 and 4. The leg member 400 is defined by a leg member first side 402, a leg member second side 404, a leg member bottom 406, a leg member top 408, and leg member front surface 401. The leg member 400 can include a panel connecting member alignment feature 422 to assist in aligning a panel connecting member 300 with the front surface 401 of the leg member. In the example shown, the connecting member alignment feature 422 is a slot or groove into which can be received the leg alignment tabs 322 of the connecting member 300 (see FIG. 13). The leg member can also include one or more securing member openings 416 (leg member securing pin opening 416) which pass through the leg member 400. The leg members 400 of the bottle rack 10 thus are elongate elements having disposed therein spaced-apart securing pin openings 416 (preferably equidistantly spaced-apart). Panel connecting members 300 can thus be attached to the leg members 400 using the securing members 600 (i.e., by placing a securing member through the connector element securing pin opening 316 and the leg member securing pin opening 416). Further, the leg bracketing tabs 324 (FIG. 13) of the connecting member 300 can placed outside of the first and second sides (402, 404) of the leg member 400, thus fixing the orientation of the connecting member 300 with respect to leg member 400. In this way connecting members 300 can be attached along the length of the leg member 400, and afterwards front (or rear) plates (100, 200) can be attached to the connecting members. In this way a two-dimensional lattice of leg members and plates (front plates or rear plates) can be assembled, as depicted by the bottle rack front assembly of FIG. 4. The length of leg members 400 can be pre-selected for a particular arrangement desired, or can be cut-to-length from leg stock members by the user. The bottom 406 of the leg member 400 is intended to rest on a support surface for the bottle rack, and can include a foot (not shown) to expand contact area with the support surface. The leg members 400 can be fabricated from plastic (such as ABS plastic) or metal. FIG. 17 is an end view of the leg member 400 of FIG. 16. In this example, the leg member 400 is formed as a channel section, which provides rigidity, bending and twisting resistance, and overall compressive strength to the leg member.

Figure 18:
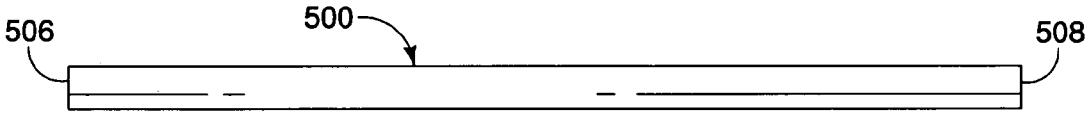
FIG. 18 is a side view of a spacing member used in the configurable bottle storage rack depicted in FIG. 1.
Figure 19:
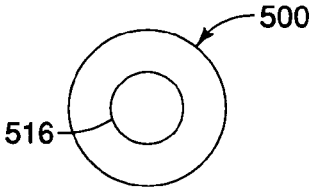
FIG. 19 is a side view of the spacing member depicted in FIG. 18.

FIG. 18 is a plan view of an exemplary spacing member 500 that can be used for the bottle storage rack 10 of FIGS. 1, 2 and 4. The spacing member 500 is an elongate member which allows the two-dimensional lattices of front plates and leg members (e.g., the bottle rack front assembly 40 of FIG. 2), and bottle rack rear assembly (e.g., 50, FIG. 2), to be secured to one another in a generally parallel and spaced-apart relationship, thus forming a three-dimensional lattice structure which generally forms the bottle storage rack 10 (FIG. 1). The spacing members 500 are defined by a first end 506 and a second end 508. In the example shown, the spacing member 500 is a circular rod, as depicted in the end view of FIG. 19. Each end (506, 508) of the spacing member 500 includes a connecting rod securing member opening 516 (securing pin opening 516) which is configured to receive a securing member 600. The spacing members 500 are generally of uniform length, although a special spacing rod of a different length can be used when the spacing rod is positioned adjacent to the special rear panel 290 for an inside corner section 30 of the bottle rack 10 (see FIG. 2). The spacing members 500 can be fabricated from plastic (such as ABS) or metal.

Figure 20:
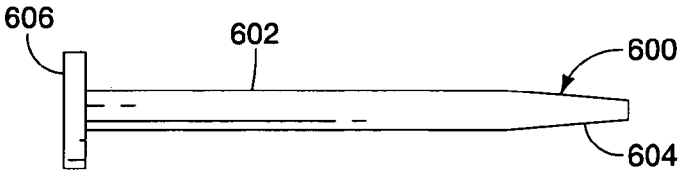
FIG. 20 is a side view of a securing member used in the configurable bottle storage rack depicted in FIG. 1.

FIG. 20 is a side view of a securing member 600 (securing pin 600) that can be used for the bottle storage rack 10 of FIGS. 1, 2 and 4. In the example depicted the securing pin is configured in the shape of a nail, having a shank 602, a tapered end 604, and a head 606. Preferably, the securing pin 600 is fabricated to cause a slight force-fit between the securing pin shank 602 and the securing pin openings in (i) the panel connecting member 300 (securing pin opening 316, FIG. 11), (ii) the leg members 400 (securing pin opening 416, FIG. 16), and (iii) the spacing member 500 (securing pin opening 516, FIG. 19). Put another way, the securing pin openings (in the just-recited components) are configured to cause a slight force-fit between the securing pin shank 602 and the securing pin openings. Further, the securing pin head 606 is configured to fit within the recess 318 (FIG. 11) in the panel connecting member 300. The securing pin 600 can be fabricated from plastic such as ABS, or from metal.

Figure 21:
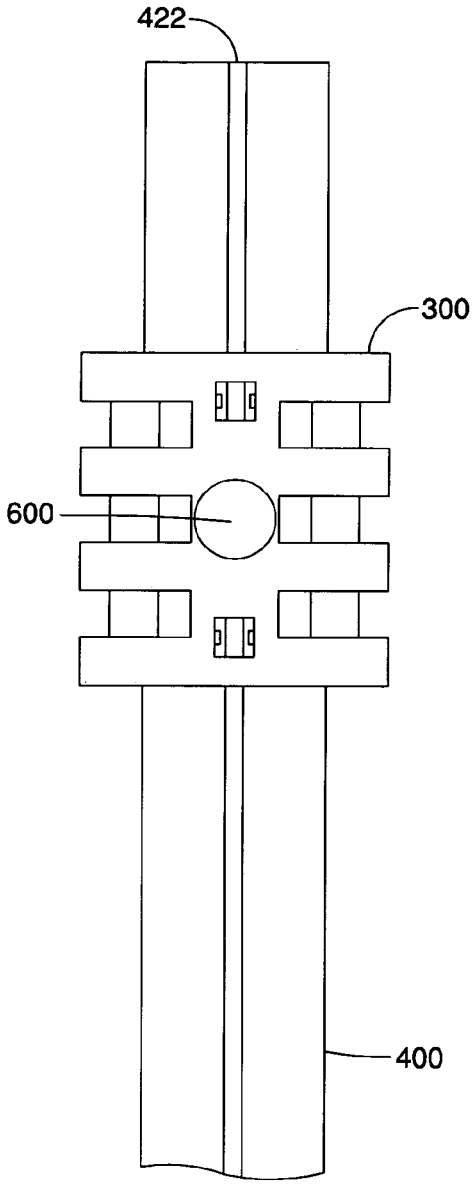
FIG. 21 is a front view depicting the panel connecting member depicted in FIG. 11 attached to the leg member depicted in FIG. 16 using the securing member depicted in FIG. 20.
Figure 22:
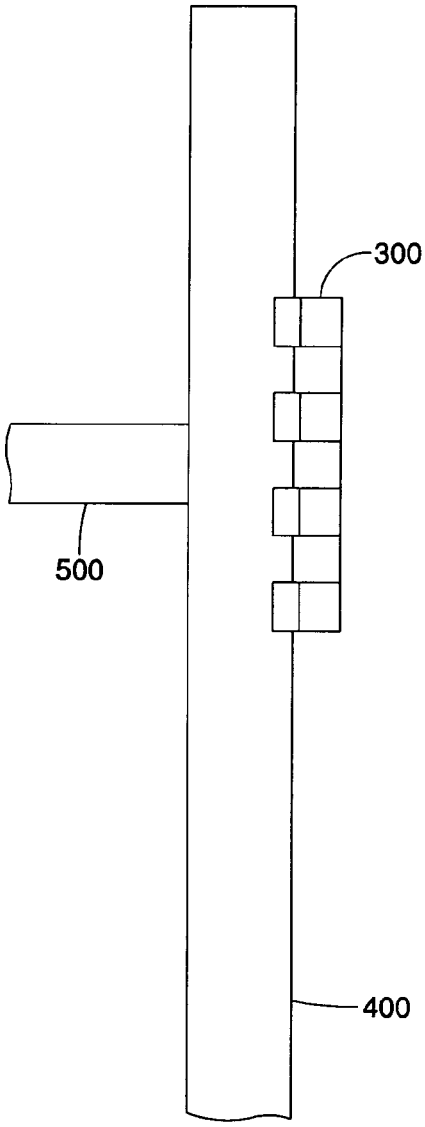
FIG. 22 is a side view of the assembly depicted in FIG. 21, also showing the spacing member depicted in FIG. 18 attached to the leg member.
Figure 23:
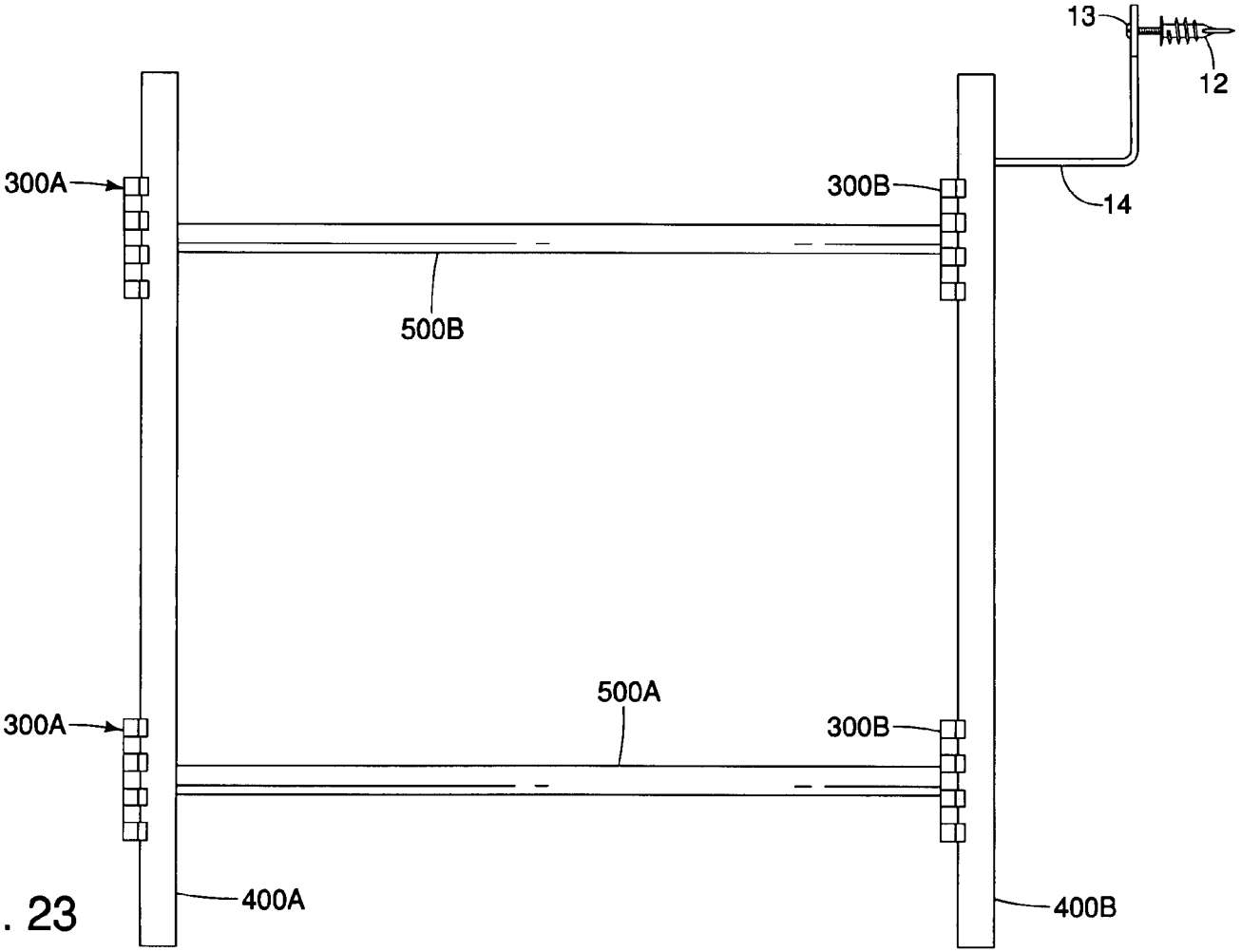
FIG. 23 is a side view of an assembly of leg members, panel connecting members and spacing members to place leg members in a spaced-apart front-to-back arrangement.

I will now describe, with respect to FIGS. 21-25, how the various component parts described above can be assembled into a bottle storage rack, such as bottle rack 10 of FIG. 1. With respect to FIG. 22, which is a front view of a panel connecting member 300 and a leg member 400, a first panel connecting member 300 is placed over a first leg member 400, using the leg alignment tab 322 (FIG. 13) and the leg bracketing tabs (324) of the connecting member to align the connecting member with the front surface (401, FIG. 16) of the leg member. The securing pin opening (316, FIG. 11) of the connecting member 300 is vertically aligned with the securing pin opening (416, FIG. 16) of the leg member 400, and a securing pin 600 is placed through the pin openings (316, 416). The shank 602 (FIG. 20) of the securing pin will project beyond the backside (rear) of the leg member 400. Turning now to FIG. 22, which is a side view of the connecting member 300 and the leg member 400 of FIG. 21, a spacing member 500 is then placed perpendicular to the leg member 400, and the projecting shank (602, not shown in FIG. 22) of the connecting member 600 is inserted into the securing pin opening (516, FIG. 19) of the first end 506 (FIG. 18) of the spacing member. With reference to FIG. 23, which is a side view of the bottle rack spacer assembly 60, second panel connecting members (300B) are then aligned with the second ends (508, FIG. 18) of the spacing members 500, aligning the securing pin openings 316 of the second panel connecting members 300B with the securing pin openings (516, FIG. 19) of the spacing members. A second leg member 400B is then placed over the rear of the second panel connecting member 300B, using the alignment tab 322 (FIG. 13) and the leg bracketing tabs 324 to align the second leg member 400B and the second connecting member 300B. Also, the securing pin opening 316 (FIG. 13) in the second panel connector member 300B is aligned with the securing pin opening 516 (FIG. 19) in the second leg member 500B, and a securing pin (600, not shown in FIG. 23) is then placed through these securing pin openings to secure the rear leg member 400B to the rear panel connecting member 300B as well as to the spacing member 500 (FIG. 22). This results in a generally "H" shaped bottle rack spacer assembly 60, which provides a structural truss component for the bottle rack (10, FIG. 2), with the vertical legs of the "H" being the first and second (front and rear) leg members 300A, 300B, and the generally horizontal cross members of the "H" being the upper and lower spacing members 500B and 500A. Going left to right (from the front to the back), with respect to FIG. 23, this "H" shaped structural component includes: (i) first panel connecting members 300A; (ii) a first vertical leg member 400A; (iii) a horizontal spacing members 500A and 500B; (iv) second panel connecting members 300B; and (v) a second vertical leg member 400B. Front and rear panels (100, 200) can then be connected to the respective first and second panel connecting members (300A, 300B) of this "H" shaped structural spacer assembly 60 in order to construct a three dimensional lattice (i.e., a bottle rack) for supporting bottles. That is, a plurality of the "H" shaped spacer assemblies 60 can be placed in spaced-apart relationship with respect to one another, separated in a horizontal direction by one or more of the front and rear panels (100, 200). Further, the "H" shaped structural spacer assemblies can be formed upward (in a vertical direction), limited only by length of the vertical leg members 400 and/or by practical considerations of height.

Figure 24:
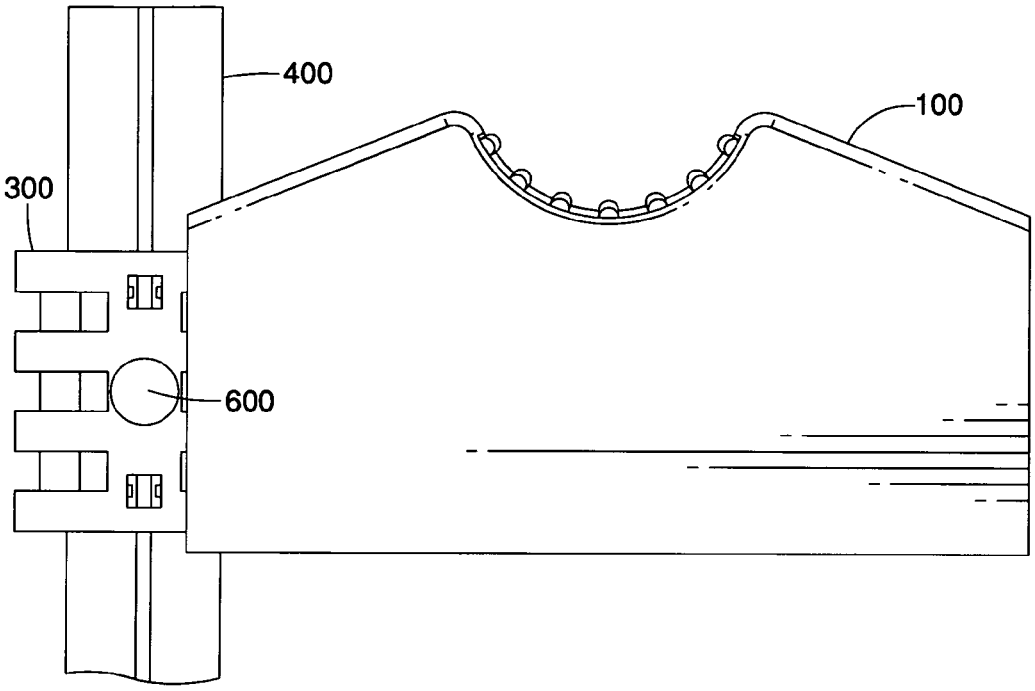
FIG. 24 is a front view depicting a front bottle support panel attached to the panel connecting member of the assembly depicted in FIG. 21.
Figure 25:
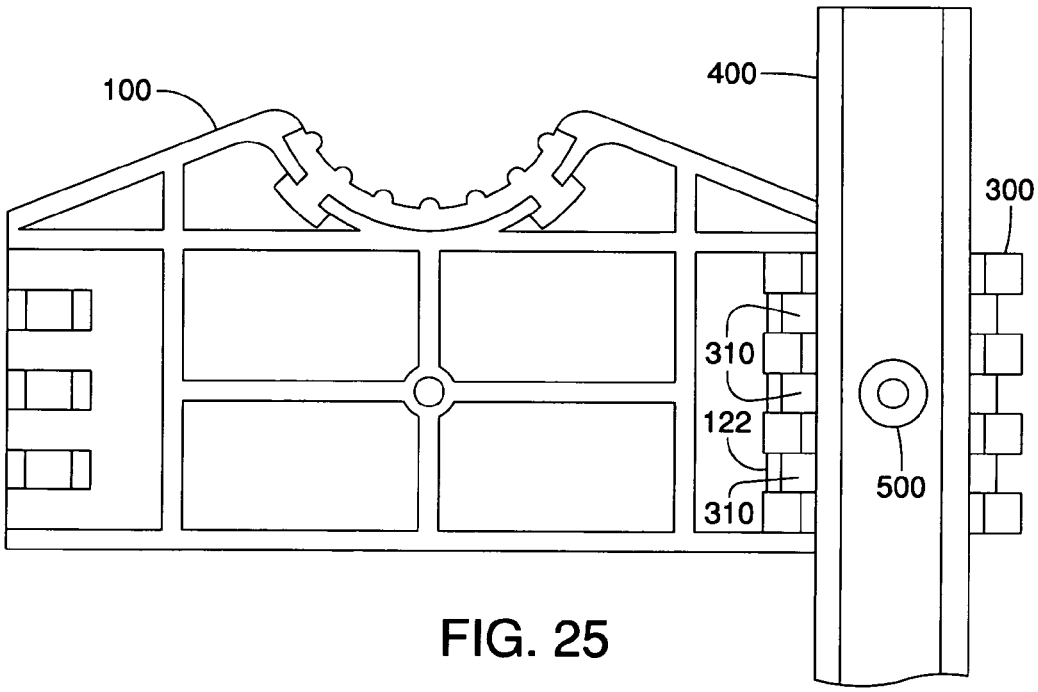
FIG. 25 is a rear view of the assembly depicted in FIG. 24.

Turning now to FIG. 24, a front view shows how a front panel 100 can be attached to the panel connecting member 300 of the assembly depicted in FIG. 21. The assembly depicted in FIG. 24 is also shown in rear view in FIG. 25. Specifically, the hinge clips 122 of the front panel 100 (see FIG. 7) are snapped into place over the hinges 310 of the panel connecting member 300. As described above with respect to FIG. 7, the clip arms 123, 125 of each hinge clip 122 will expand to allow the hinge 310 to be received into the hinge receiver 127 of the hinge clip, and will then resiliently return to position to thereafter hold the hinge within the hinge receiver.

With respect to the description above regarding assembling the initial bottle rack spacer assembly 70 (FIG. 23), it will be appreciated the further construction of the bottle rack (e.g., the bottle rack straight section 20 of FIGS. 3 and 4) can proceed as follows. Once front panels 100 and rear panels 200 are attached to the respective front and rear panel connecting members 300A, 300B, then additional front and rear panel connecting members 300A, 300B can be connected to the attached panels 100, 200. This holds the second set of panel connecting members 300 in place so that additional leg members 400 and additional spacing members 500 can be attached to the second set of panel connecting members using the securing members 600 (FIG. 21). Of course, leg members 400 do not need to be positioned at each panel connecting member 300 (as can be seen from FIG. 2), and two or more panels (100 or 200) can be joined together before an additional leg member 400 is added to the structure.

Once the desired configurable bottle storage rack 10 (FIG. 1) has been assembled and put in place, the bottle rack can be secured to a wall (as depicted in FIG. 3) using wall mounting hardware. Exemplary wall mounting hardware is depicted in FIG. 23. The wall mounting hardware depicted in FIG. 23 includes a wall mounting bracket 13 which can be secured to the rear leg member 400B using the securing member 600 (not shown in FIG. 23). A wall anchor 12 and screw 13 can then be used to secured the wall mounting bracket 13 (and thus the bottle rack) to a wall. Additional mounting brackets can be used to secure the constructed bottle rack 10 to proximate floor and ceiling surfaces to thus assist in holding the bottle rack in place with respect to its surrounding environment.

Figure 27:
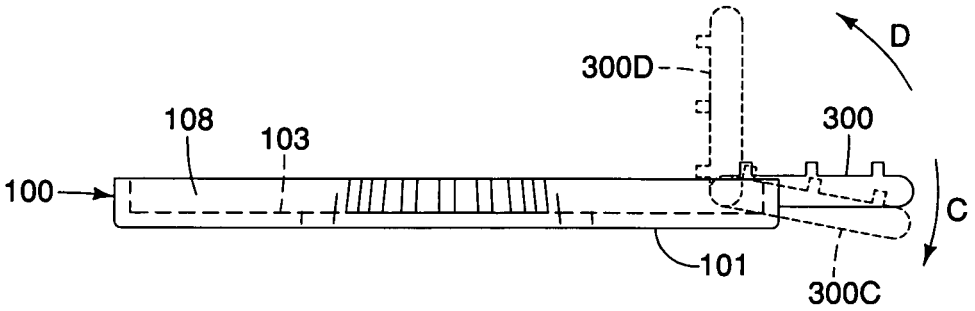
FIG. 27 is a plan view of a front bottle support panel attached to a panel connecting member, depicting how the panel connecting member can be rotated with respect to the front panel.

As indicated above, a significant feature of the bottle storage rack provided for herein is the ability to place the rack around the inside corner or a wall in a curved manner, as shown by bottle rack corner section 30 of FIGS. 2 and 3. This provides for a more elegant solution to navigating an inside corner, versus merely extending a straight section of the bottle rack (such as bottle rack straight section 20 of FIGS. 2 and 3) to the inside corner. Further, the bottle storage rack provided for herein can negotiate an inside corner using very few bottle storage positions, which allows for efficient use of space. The ability of the bottle storage rack described herein to be placed in a space-efficient manner around an inside corner is primarily provided by the connection between the panel connecting members 300 and the panels (front panels 100 and rear panels 200). More specifically, the panel connecting members 300 and the panels (front panels 100 and rear panels 200) are configured to be connected to one another (i.e., the panel-to-connector connection) such that the panel connector can rotate outwards in order to allow an angle to be formed between adjacent panels. This is depicted in FIG. 27, which is a top view of a front bottle support panel 100 attached to a panel connecting member 300, depicting how the panel connecting member can be rotated with respect to the front panel. In this exemplary figure the connecting member 300 is shown by solid lines in the position in which is would be placed for a straight section (20, FIG. 2) of the bottle rack. The connecting member 300 can rotate outward with respect to the front panel 100 (i.e., in direction "C") towards the outside surface 101 of the front panel to the position indicated in phantom lines by 300C. The connecting member 300 can also rotate inward with respect to the front panel 100 (i.e., in direction "D") towards the inside surface 103 of the front panel to the position indicated in phantom lines by 300D. The ability of the connecting member 300 to rotate outward in direction "C" is provided by moving the hinges 310 (FIG. 11) of the connecting member slightly away from the inside surface 103 (FIG. 7) of the front panel 100. As described above, this is accomplished by placing a hinge clip post (e.g., 149, FIGS. 10 and 10A) between the inside surface 103 of the front panel and the hinge receiver (e.g., 147, FIG. 10A). The hinge clip post (149) thus provides a stand-off for the hinges 310. Forward rotation of the panel connecting member 300 is also provided by allowing the hinge openings (144, FIGS. 9 and 10) to extend all the way down to the inside surface 103 of the front panel 100. The desired amount of forward (or outward) rotation (i.e., rotation in direction "C", FIG. 27) of the panel connector 300 can be by accomplished by selecting an appropriate height for the hinge clip post (e.g., 149). In one example a hinge clip post height of about 2 to 3 mm allows for forward rotation of the panel connecting member 300 of about 15 degrees from the straight position. Greater outward rotation of the panel connecting member 300 with respect to the front panel 100 can be accomplished by extending the hinge openings (144, FIG. 10) into the area of the front panel between the outside surface 101 and the inside surface 103 proximate the first and second sides (102, 104, FIG. 7) of the front panel. However, this incursion of the hinge openings into the sides (102, 104) of the front panel reduces structural support for the outer clip arms (e.g., clip arm 123, FIG. 7) of the associated hinge clips (e.g., hinge clip 122, FIG. 7). It will be appreciated that the foregoing description and discussion applies equally well to rear panels 200 and their connection to panel connecting members 300. Preferably, the front panels 100 and the panel connecting members 300 are configured to allow at least 22.5 degrees of rotation between adjacent front panels (and similarly with respect to rear panels 200) when the panels (100, or 200) are connected together by the panel connecting members 300. That is, it is desirable to allow at least 11.25 degrees of rotation between a panel connecting member 300 and the panel (100 or 200) to which it is attached. In this way four front panels 100 can be connected to one another by five panel connecting members 300, and the front panels can be moved into a 90 degree arc (as depicted in FIG. 2), which allows the bottle rack to form a bottle rack inside corner section 30 which can be placed around an inside corner.

As depicted in FIG. 2, the bottle rack inside corner section 30 includes four front panels 100 and seven rear panels 200. In one variation, a greater number of front panels 100 and rear panels 200 can be used to increase the radius of the bottle rack inside corner section 30. Also, in another variation, the radius of the bottle rack inside corner section 30 can be reduced by using three front panels 100 and five rear panels 200. In this latter variation the minimum allowed outward rotation of the panel connecting member 300 with respect to the front panels 100 must be increased to at least 15 degrees in order to accommodate a 90 degree arc. It is also to be noted that less outward rotation is required between rear panels 200 and the panel connecting members 300 than is required between front panels 100 and the panel connecting members, due to the increased number of rear panels (over front panels) that are required to circumscribe a 90 degree arc. This allows the rear panels 200 to be configured slightly differently from the front panels 100 with respect to features (such as hinge post height and hinge opening incursions into the sides of the panels) which allow for greater or lesser outward rotation of the panel connecting member 300.

In addition to the allowed outward rotation (rotation in direction "C", FIG. 27) of the panel connecting members 300 with respect to the front and rear panels (100, 200), the ability of the configurable bottle storage rack 10 to accommodate an inside corner (via an inside corner section, such as bottle rack inside corner section 30, FIG. 2) is affected by the width of the front and rear panels (100, 200), and the spacing between the panels established by the panel connecting members 300. That is, the width of the front and rear panels (100, 200), and the dimensions of the spacing between adjacent panels as determined by the connection of two adjacent panels via a panel connecting member 300, are selected such that whole numbers of panels (100, 200) can be arranged in an inside corner section (e.g., inside corner section 30, FIG. 2) without resulting in any fractional panels being required to circumscribe a 90 degree arc. In the example depicted in FIG. 2 (wherein four front panels 100 and seven rear panels 200 are employed to circumscribe a 90 degree arc), the width of the front panels 100 and the rear panels 200 is about 92 mm. (The width of the panels 100, 200 is the dimension between the respective first sides 102, 202 and the respective second sides 104, 204 of the panels.) Further, in this example the spacing between adjacent front panels 100 (and adjacent rear panels 200) provided by the panel connecting members 300 is about 10 mm when the panels lie in the same plane (i.e., one panel is not rotated with respect to the adjacent panel).

As depicted in FIG. 27, and as described above, the panel connecting member 300 is preferably configured to allow inward rotation of the panel connecting member with respect to the front panel 100 (i.e., rotation in direction "D") of at least 90 degrees. This allows two bottle rack straight sections 20 (FIG. 3) to be connected to one another and placed around an outside corner "OC" of a wall, as depicted in FIG. 3 (and specifically, by allowing a 90 degree rotation between two adjacent rear panels 200 which parallel the outside corner). This arrangement (of two adjacent rear panels 200 rotated with respect to one another by 90 degrees by virtue of the 90 degree inward rotation of the panel connecting member 300 connecting the adjacent rear panels) allows a contiguous bottle rack 10 to accommodate an outside corner, versus having two separate and unconnected sections of the bottle rack being placed at the outside corner. (In the example depicted in FIG. 3, it will be noted that the front panels 100 at the outside corner "OC" are not connected to one another.) Allowing for connected sections of the bottle rack to be placed at an outside corner increases the overall structural integrity of the bottle rack, and reduces the requirement to place wall anchors (12, FIG. 3), along with accompanying leg members 400, at proximate positions inward of the outside corner in order to provide stability for the bottle rack 10. It will also be appreciated that when the panel connecting member 300 is rotated 90 degrees (e.g., to the position 300D depicted in FIG. 27), then the panel connecting member can be used as a wall anchor point by attaching a wall anchor to the panel connecting member using the hole 316 (FIG. 11) therein.

As described immediately above, the bottle rack 10 disclosed herein can accommodate the outside corner of a wall (e.g., outside corner "OC", FIG. 3) by inward rotation (i.e., rotation in direction "D", FIG. 27) of a panel connecting member 300 with respect to two adjacent rear panels 200. However, the configurable bottle storage rack provided for herein can also negotiate the outside corner of a wall with a radiused bottle rack outside corner accommodating section (not shown in the drawings). The radiused bottle rack outside corner accommodating section basically forms a 90 degree radiused arc around an outside corner. In the arrangement, the front panels 100 and rear panels 200 of the outside corner section are placed into an essentially concave arrangement with respect to their outward facing surface (i.e., facing away from the outside corner), versus the essentially convex arrangement (when view from the front surfaces 101 of the front panels 100) of the inside-corner accommodation section 30 of FIG. 2. In this instance the number of front panels 100 will be greater than the number of rear panels 200. However, no special front panel (similar to the special rear panel 290 of FIG. 6A) needs to be provided at the apex of the corner, since there is no rear leg member 400 proximate the outside corner to which the central front panel can be connected.

In yet a further variation the configurable bottle storage rack of the present disclosure can be provided with an external support frame (not shown in the drawings) which can fit around the bottle storage rack in order to provide additional rigidity, structural strength, and overall support for the bottle rack. The external frame can be fabricated from metal, wood and/or plastic, and can fit around the sides, top and/or bottom of the bottle storage rack. For example, if a user desires a simple 8X20 bottle rack (i.e., configured to accommodate eight bottles horizontally and twenty bottles vertically), not to be attached to any wall structure or the like, then the user can order an external support frame to fit around the bottle rack, and thus ensure that the bottle rack will not experience undesirable sway (i.e., bending and rotation about the lowest level). More specifically, the external support frame can be configured to resist overturning moments due to earthquakes.

Referring to FIGS. 5 and 6, a further feature of the configurable bottle storage rack provided for herein is the use of front panels 100 that are configured to support the neck of a bottle (such as a wine bottle), and rear panels 200 that are configured to support the wider bottom portion of a bottle (again, such as a wine bottle). This is a significant advantage over prior bottle storage racks which use identical horizontal members (typically wood bars) to support both the front and back of a wine bottle. That is, in the prior art the neck of the wine bottle is typically forced into a downward-angled position relative to the bottom of the wine bottle, thus allowing dregs (sediment and the like) to gravitate towards the neck of the bottle. However, the arrangement of the present disclosure keeps a wine bottle in an essentially horizontal position, thus allowing the dregs to precipitate in the main body of the bottle. This reduces the chance that dregs (sediment) will be poured out when decanting the wine. (Basically, the dregs will be located closer to the bottom of the wine bottle, so when the bottle is placed in the upright position for opening of the bottle, there will be reduced mingling of the dregs with the wine.) This is provided for by the bottle neck support surface 109 in the front panel 100 (FIG. 5) and the bottle bottom support surface 209 in the rear panel 200. The elevation of each bottle support surface (109, 209) with respect to one another can be adjust by providing non-slip bottle neck supports (e.g., 110, FIG. 7) of varying thicknesses. Thus, for example, a user may wish to use a non-slip bottle neck support (e.g., 110, FIG. 7) having a greater thickness for pinot-type bottles (which have a greater bottle bottom diameter than Bordeaux-type bottles) in order to account for larger bottle bottom diameter, and thus promote settlement of dregs in the pinot-type bottle away from the neck of the bottle.

After assembly of the bottle storage rack 10, the application of a glue (such as a cyanoacrylate adhesive) to all of the joints and securing pin attachment points can provide additional rigidity to the bottle rack, and prevent the components from becoming inadvertently disconnected from one another.

As indicated herein, the present disclosure not only provides for a configurable bottle storage rack (e.g., 10, FIG. 1), but also provides for a configurable wine rack storage rack kit, the configurable wine rack storage rack kit including: (i) a plurality of front bottle support panels (e.g. 100, FIG. 5); and (ii) a plurality of rear bottle support panels (e.g., 200, FIG. 6). Each front bottle support panel is defined by front bottle support panel first and second sides (e.g., 102, 104, FIG. 5), and each front bottle support panel includes a front bottle support panel hinge section (e.g., 120 and 140, FIG. 7) located at the first and second sides thereof. Further, each rear bottle support panel is defined by front bottle support panel first and second sides (e.g., 202, 204, FIG. 6), and each rear bottle support panel includes a rear bottle support panel hinge section (e.g., 220, 240, FIG. 8) located at the first and second sides thereof. The configurable wine rack storage rack kit further includes a plurality of panel connecting members (e.g., 300, FIG. 15), each panel connecting member being defined by first and second sides thereof (e.g., 302, 304), and each panel connecting member having a hinge (e.g., 310) located at the first and second sides thereof. The kit also includes: (i) a plurality of leg members (e.g., 400, FIG. 16); and (ii) a plurality of spacing members (e.g., 500, FIG. 18). The front bottle support panels (100) can be connected to one another by engaging the hinges (310) of the panel connecting members (300) to the front bottle support panel hinge sections (e.g., 120, 140). Likewise, the rear bottle support panels (200) can be connected to one another by engaging the hinges (310) of the panel connecting members (300) to the rear bottle support panel hinge sections (e.g., 220, 240). The panel connecting members (300) can be attached to the leg members (400), and the spacing members (500) can be disposed between leg members (400) where panel connecting members (300) are be attached to the leg members.

The configurable wine rack storage rack kit can further include a plurality of securing members (e.g., 600, FIG. 20), the securing members including a securing member shank (602). The panel connecting member (300) can include a central element (320, FIG. 4) disposed between the panel connecting member first and second sides (302, 304), the central element having a panel connecting member securing member opening (316, FIG. 11) defined therein. Further, the leg members (400) can each have at least one leg member securing member opening (416) defined therein. Still further, the spacing members (500) can be elongate rods defined by spacing member first and second ends (506, 508, FIG. 18), and each spacing member first and second end can have a spacing member securing member opening (e.g., 516, FIG. 19) defined therein. The securing members (600) can thus connect one of the panel connecting members (300), one of the leg members (400), and one of the spacing members (500) by inserting the securing member shank (602) into the securing member openings defined in the panel connecting member, leg member and spacing member (respectively, openings 316, 416 and 516). The various components of the configurable wine rack storage rack kit (and in particular, the front panels 100, the rear panels 200, the panel connecting members 300, and the leg members 400) can further any of the features described above with respect to these components. The kit can also include the special rear panel (290, FIG. 6A) which enables four front panels (100) and seven rear panels (200) to be used in a bottle rack inside corner accommodating section (e.g., 30, FIG. 2).

An additional embodiment of the bottle storage rack provided for herein can be described as follows. A configurable bottle storage rack includes a bottle rack front assembly (e.g., 40, FIG. 2) and a bottle rack rear assembly (e.g., 50, FIG. 2). The bottle rack front assembly includes a plurality of front bottle rack support panels (e.g., 100, FIG. 5) which are arrayed in rows and columns. When the front bottle rack support panels are placed in adjacent position to one another in a row, they are connected to one another in a spaced-apart relationship by a panel connecting member (e.g., 300, FIG. 15). When the front bottle rack support panels are placed in adjacent position to one another in a column, they are spaced-apart from one another by a front vertical leg member (e.g., 400, FIGS. 1 and 16) which is attached to a front panel connecting member. Front bottle rack support panels at the ends of the rows are also connected to panel connecting members, and these end panel connecting members (which do not necessarily connect two adjacent front panels) are preferably attached to front leg members in order to provide support for the bottle rack front assembly. Similarly, the bottle rack rear assembly includes a plurality of rear bottle rack support panels (e.g., 200, FIG. 6) which are arrayed in rows and columns. When the rear bottle rack support panels are placed in adjacent position to one another in a row, they are connected to one another in a spaced-apart relationship by a rear panel connecting member (e.g., 300, FIG. 15). When the rear bottle rack support panels are placed in adjacent position to one another in a column, they are spaced-apart from one another by a rear vertical leg member (e.g., 400, FIGS. 1 and 16) which is attached to a rear panel connecting member. Rear bottle rack support panels at the ends of the rows are also connected to panel connecting members, and these end panel connecting members (which do not necessarily connect two adjacent rear panels) are preferably attached to rear leg members in order to provide support for the bottle rack front assembly. It will be appreciated the front leg members and the rear leg members can be essentially similar to one another (save for differences in length to accommodate a particular configuration of the bottle storage rack), and that the front and rear panel connecting members can be essentially the same. The bottle rack front assembly and the bottle rack rear assembly are placed in essentially parallel and spaced-apart relationship to one another by spacing members (e.g., 500, FIGS. 1 and 2). The spacing members are preferably attached to the leg members (i.e., positioned between associated front and rear leg members) either directly or by way of an intervening panel connecting member. (For example, a spacing member (e.g. 500A, FIG. 23) can be placed between a front leg member (e.g., 400A) and a rear panel connecting member (e.g., 300B), as depicted in FIG. 23.

Further, the panel connecting members (e.g., 300, FIGS. 1, 2 and 15) include hinges (e.g., 300, FIG. 15) which are configured to engage with front panel hinge sections (e.g., 120 and 140, FIG. 7) and rear panel hinge sections (e.g., 220 and 240, FIG. 8). The connection between the panel connecting member hinges and the hinge sections of the front and rear panels allow adjacent panels (i.e., horizontally adjacent front panels and horizontally adjacent rear panels) to rotate towards one another in both a forward direction (i.e., in direction "C" of FIG. 27) and in a rearward (or backward) direction (i.e., in direction "D" of FIG. 27). Preferably, the hinges and hinge sections are configured to allow horizontally adjacent front panels (and likewise, horizontally adjacent rear panels) to rotate towards one another in the forward direction in order to achieve an angle between horizontally adjacent panels of at least about 22.5 degrees. Put another way, preferably the hinges and hinge sections are configured to allow a panel connecting member to rotate in a forward direction with respect to an associated (i.e., connected) panel (front or rear panel) by about at least 11.25 degrees. Such a configuration allows for four front panels, and seven rear panels, to be configured into an arc of 90 degrees, which allows the portion of the bottle rack including such panels (i.e., a bottle rack inside corner accommodating section, e.g., 30, FIGS. 1 and 2) to be placed proximate an inside corner of a wall (e.g., inside corner "IC" of wall "W"), as depicted in FIG. 3. In one configuration forward rotation of a panel connecting member with respect to an associated panel (front or rear panel) can be achieved by providing a hinge post (e.g., 149, FIG. 10) which spaces a panel connecting member hinge (e.g., 310, FIG. 11) away from the panel. In another configuration forward rotation of a panel connecting member with respect to an associated panel (front or rear panel) can be achieved by providing at least one opening into the front surface of a panel (e.g., front surface 101 of front panel 100, FIG. 5, or front surface 201 of rear panel 200, FIG. 6), such opening into the panel front surface allowing a portion of the panel connecting member to rotate in the forward direction (i.e., direction "C", FIG. 27) with respect to the panel.

Still further, and following along the description in the above paragraph, the configurable bottle storage rack can include a special rear panel 290 (e.g., FIGS. 1, 2 and 6A) which allows a leg member (e.g., 400), and a spacing member (e.g., 500) to be placed at a 45-degree position at the fourth rear panel (i.e., central rear panel) within a 90-degree bottle rack inside corner section (e.g., 30), without a panel connecting member.

As described above, the components of the bottle rack front assembly (e.g., 40), the bottle rack rear assembly (e.g., 50), and the spacing members (e.g., 500) can be assembled into the configurable bottle storage rack (e.g., 10, FIGS. 1 and 2) using securing members (e.g., 600, FIG. 20).

Other advantages of the configurable bottle storage rack, and configurable bottle storage rack kit, described herein above are as follows. In general, the components of the configurable bottle storage rack (e.g. the front and rear panels 100, 200, the panel connecting members 300, the leg members 400, the spacing members 500, and the securing members 600) can be assembled into a bottle storage rack without the use of any auxiliary tools (such as a screw driver, wrench, hammer, etc.). The components of the configurable bottle storage rack can all be fabricated from a rigid plastic material, such as ABS, as well as from metal, wood, and combinations thereof. The components of the configurable bottle storage rack, and the configurable bottle storage rack kit, all as described herein, are generally configured (by way of all of the various limitations described herein above) such that a user assembling the configurable bottle storage rack using the components of the configurable storage rack kit cannot misassemble the parts, which is a common problem of many prior art furniture kits and the like. While the currently described configuration of components does allow for a user to connect a front panel (100) and a rear panel (200) adjacent to one another (separated only by a panel connecting member 300), it is unlikely that a user will make this mistake since in almost universal orientation bottles are placed in a bottle storage rack with the bottle neck extending outward for ease of grasping the bottle (and identifying the bottle), and a user will be well aware if he or she is assembling the bottle rack front assembly (40, FIG. 2) or the bottle rack rear assembly (50, FIG. 2). Further, for certain purposes, a user may select to configure the configurable bottle storage rack such that at certain locations within the bottle rack the necks of bottles are supported proximate the rear of the bottle rack (which would place the front panels 100 in the bottle rack rear assembly 50). Which all serves to demonstrate the highly configurable arrangement of a bottle rack provided for by the present disclosure. A further advantage of the bottle storage rack provided for herein is that the bottle storage rack will tend to resist bending motions in all directions as a result of being a three-dimensional structure, and thus compressive forces imparted to one component will be resisted by equal and opposite tension forces imparted to that component, or to an associated component. (For example, forward bending motion imparted to the front leg member 400A of FIG. 23, resulting in compressive forces being imparted to the front leg member 400A, will be resisted by equal and opposite tension forces being imparted to the rear leg member 400B.) Thus, the overall structural rigidity of the bottle storage rack 10 (FIGS. 1 and 2) is enhanced by virtue of this three-dimensional interconnected relationship of the various components, as well as by any attachments of the bottle storage rack to surrounding environmental components (such as walls, floorings and ceilings).

Figure 28:
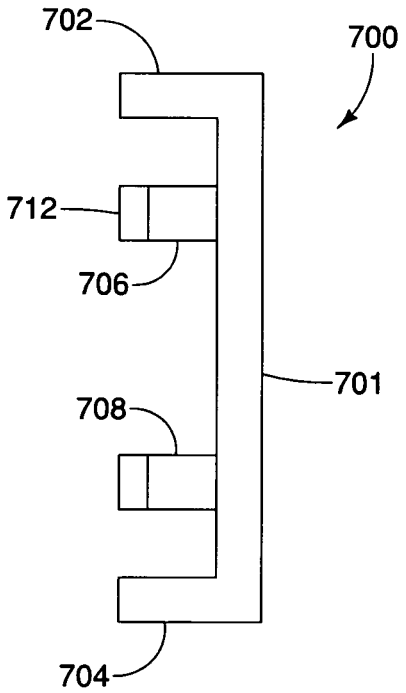
FIG. 28 is a side view of a panel gap cover that can be used to cover a gap between adjacent front panels and adjacent rear panels.
Figure 29:
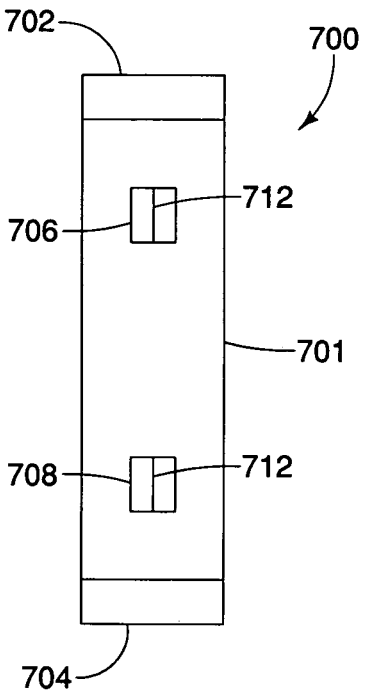
FIG. 29 is a rear view of the panel gap cover of FIG. 28

It will be appreciated that bottle storage racks can be used for the storage of premium wines and spirits, and that visual appearance of the bottle storage rack can be a significant factor in motivating a user to implement a particular bottle storage rack. In the instance of the above-described bottle storage rack 10, it will be appreciated that the exposed connecting member central element 320 of the panel connecting member 300, which is visible between adjacent front panels 100 (see FIG. 4, for example), can present a rough or unfinished visual appearance to the bottle rack front assembly 40. Accordingly, it is desirable that a component be provided which can cover the exposed connecting member central element 320, and thus present a more finished visual appearance to the bottle rack front assembly 40. This can be accomplished by providing a panel gap cover over the exposed connecting member central element 320 between front adjacent panels 100 (as well as between adjacent rear panels 200). An example of a panel gap cover 700 is provided in side view in FIG. 28, and in rear view in FIG. 29. The exemplary panel gap cover 700 includes a front piece 701 which is configured to be placed over the connecting member central element 320 (e.g., FIG. 4) between adjacent front panels (100) and/or rear panels (200). The panel gap cover 700 can further include a top member 702 and a bottom member 704, which are configured and sized to fit over the respective panel connector top member 308 and the panel connector bottom member 306 of the panel connecting member 300. The panel gap cover 700 can further include panel gap cover securing extensions 706 which extend in the direction of the panel gap cover top and bottom members 702, 704 (i.e., away from the front piece 701), and which are configured to be received within the gap cover securing extension receptacles 330 (FIG. 11) in the panel connecting members 300, and held in place therein by the gap cover securing tabs 332. The panel gap cover securing extensions 706 can be formed with a wedged edge 712 in order to facilitate introduction of the gap cover securing extensions into the gap cover securing extension receptacles 330 in the panel connecting members 300. The gap cover 700 is preferably fabricated from a material such as rubber in order to allow the gap cover to easily adapt to the compression of the gap cover that will be experienced between inwardly angled front panels 100 in the bottle rack inside corner section 30, as well as to be held in place by the gap cover securing tabs 332.

The preceding description has been presented only to illustrate and describe exemplary components of the present invention. It is not intended to be exhaustive or to limit the disclosure to any precise form disclosed. Many modifications and variations are possible in light of the above teachings. It is intended that the scope of the invention be defined by the following claims.

We claim:

1. A modular bottle storage rack, comprising:

a plurality of panel connecting members, each panel connecting member being defined by first and second sides thereof;

a first leg member;

a first one of the panel connecting members being attached to the first leg member;

a second leg member;

a second one of the panel connecting members being attached to the second leg member;

a first plurality of front bottle support panels, each front bottle support panel defined by front bottle support panel first and second sides, the first plurality of front bottle support panels being arranged in horizontal spaced-apart relationship;

the first side of a first one of the front bottle support panels being connected to the second side of the first panel connecting member, and the second side of a second one of the front bottle support panels being connected to the first side of the second panel connecting member, and wherein for each instance where front bottle support panels are adjacent to one another, the adjacent front bottle support panels are connected to one another using a further one of the plurality of panel connecting members;

a third leg member;

a third one of the panel connecting members being attached to the third leg member;

a fourth leg member;

a fourth one of the panel connecting members attached to the fourth leg member;

a first plurality of rear bottle support panels, each rear bottle support panel defined by rear bottle support panel first and second sides, the first plurality of rear bottle support panels being arranged in horizontal spaced-apart relationship;

the first side of a first one of the rear bottle support panels being connected to the second side of the third panel connecting member, and the second side of a second one of the rear bottle support panels being connected to the first side of the fourth panel connecting member, and wherein for each instance where rear bottle support panels are adjacent to one another, the adjacent rear bottle support panels are connected to one another using a further one of the plurality of panel connecting members;

a first spacing member disposed between the first and third leg members at the first and third panel connecting members;

a second spacing member disposed between the second and fourth leg members at the second and fourth panel connectors;

the panel connecting members are connected to the bottle front support panels in a hinged manner to allow adjacent bottle front support panels to be bent into a concave shape with respect to one another; and the panel connecting members are connected to the bottle rear support panels in a hinged manner to allow adjacent bottle rear support panels to be bent into a concave shape with respect to one another;

wherein the leg members are upright posts that enable the front and rear bottle support panels to be supported and elevated above a floor or ground surface;

wherein bottles are each configured to rest upon a corresponding pair of front and rear bottle support panels in a horizontal manner without falling off the rack.

2. The configurable bottle storage rack of claim 1 and further comprising:

a second plurality of bottle front support panels connected together in side-by-side horizontal arrangement by further ones of the panel connecting members;

a second plurality of bottle rear support panels connected together in side-by-side horizontal arrangement by further ones of the panel connecting members;

the second plurality of bottle front support panels and associated panel connecting members are supported above the first plurality of bottle front support panels by the first and second legs; and the second plurality of bottle rear support panels and associated panel connecting members are supported above the first plurality of bottle rear support panels by the third and fourth legs.

3. The configurable bottle storage rack of claim 1 and wherein:

the panel connecting members include a first hinge located proximate the panel connecting member first side; and a second hinge located proximate the panel connecting member second side;

the bottle front support panels include a front panel first hinge section located proximate the bottle front support panel first side, and a front panel second hinge section located proximate the bottle front support panel second side;

the bottle rear support panels include a rear panel first hinge section located proximate the bottle rear support panel first side, and a rear panel second hinge section located proximate the bottle rear support panel second side; and the hinge sections are configured to receive the hinges.

4. The configurable bottle storage rack of claim 3 and wherein the hinges can rotate in a forward direction within the hinge sections by an angle of at least about 12 degrees.

5. The configurable bottle storage rack of claim 4 and wherein the hinges can rotate in a backward direction within the hinge sections by an angle of at least 90 degrees.

6. The configurable bottle storage rack of claim 1 and wherein the bottle storage rack is configured in a ninety degree arc to fit around an inside corner of a wall, wherein:

the first plurality of bottle front support panels consists of four of the bottle front support panels; and the first plurality of bottle rear support panels consists of seven of the bottle rear support panels.

7. The configurable bottle storage rack of claim 6 and further comprising:

the first and second bottle front support panels are located at ends of the ninety degree arc;

third and fourth bottle front support panels are disposed between the first and second bottle front support panels;

a fifth leg member is attached to the panel connecting member located between the third and fourth bottle front support panels;

the first and second bottle rear support panels are located at ends of the ninety degree arc;

third through seventh bottle rear support panels are disposed between the first and second bottle rear support panels;

a sixth leg member is attached to a proximate a center of the fourth bottle rear support panel; and a third support member is disposed between the fifth leg member and the sixth leg member.

8. The configurable bottle storage rack of claim 3 and wherein each front panel hinge section and each rear panel hinge section comprises a plurality of hinge clips, each hinge clip comprising a pair of clip arms which define a hinge receiver, and wherein the clip arms hold the hinge of the panel connector member into the hinge receiver.

9. The configurable bottle storage rack of claim 8 and wherein each bottle front support panel and each rear support panel is defined by an inside surface, and wherein the hinge receivers are spaced apart from the inside surface by a hinge post.

10. The configurable bottle storage rack of claim 8 and wherein the first and second sides of each bottle front support panel and each bottle rear support panel are defined by a hinge opening which allows the hinges of the panel connecting members to rotate by a limited amount within the hinge clips.

11. The configurable bottle storage rack of claim 1 and wherein:

each bottle front support panel is defined by a front panel top side, and each front panel top side has a concave bottle neck support surface defined thereon; and each bottle rear support panel is defined by a rear panel top side, and each rear panel top side has a concave bottle bottom support surface defined thereon.

* * * * *